US006845226B2

(12) United States Patent
Tatematsu et al.

(10) Patent No.: US 6,845,226 B2
(45) Date of Patent: Jan. 18, 2005

(54) IMAGE HEATING DEVICE AND IMAGE FORMING APPARATUS USING THE SAME

(75) Inventors: Hideki Tatematsu, Ashiya (JP); Kenji Asakura, Souraku-gun (JP); Masaru Imai, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/625,223

(22) Filed: Jul. 22, 2003

(65) Prior Publication Data

US 2004/0101334 A1 May 27, 2004

Related U.S. Application Data

(62) Division of application No. 09/868,361, filed as application No. PCT/JP00/07486 on Oct. 25, 2000, now Pat. No. 6,725,009.

(30) Foreign Application Priority Data

Oct. 26, 1999 (JP) ..... 11-303641
Jun. 23, 2000 (JP) ..... 2000-188932

(51) Int. Cl.[7] ..... G03G 15/20

(52) U.S. Cl. ..... 399/329; 399/69; 399/328; 219/216; 219/619

(58) Field of Search ..... 219/216, 619; 399/67, 69, 70, 88, 320, 324, 328, 329, 330, 331, 332, 333, 337

(56) References Cited

U.S. PATENT DOCUMENTS 5,752,148 A 5/1998 Yoneda et al.
6,175,713 B1 1/2001 Uehara et al.

FOREIGN PATENT DOCUMENTS

| | | |
|---|---|---|
| EP | 0 363 686 | 4/1990 |
| EP | 0 679 961 | 11/1995 |
| JP | 5-19653 | 1/1993 |
| JP | 5-46050 | 2/1993 |
| JP | 5-150675 | 6/1993 |
| JP | 6-202522 | 7/1994 |
| JP | 7-160133 | 6/1995 |
| JP | 7-253733 | 10/1995 |
| JP | 8-6413 | 1/1996 |
| JP | 8-137306 | 5/1996 |
| JP | 9-134084 | 5/1997 |
| JP | 9-190105 | 7/1997 |
| JP | 9-197869 | 7/1997 |
| JP | 10-74007 | 3/1998 |
| JP | 10-104975 | 4/1998 |
| JP | 10-123861 | 5/1998 |
| JP | 10-171296 | 6/1998 |
| JP | 10-301432 | 11/1998 |
| JP | 10-340019 | 12/1998 |

*Primary Examiner*—Hoang Ngo
(74) *Attorney, Agent, or Firm*—Merchant & Gould P.C.

(57) ABSTRACT

An image heating device with a small thermal capacity that can be heated rapidly. The image heating device includes a fixing belt (20) having a heat resistance; a rotatable heat-generating roller (21), which is at least partially conductive and arranged in contact with an inner peripheral surface of the fixing belt (20); a fixing roller (22), the fixing roller and the heat-generating roller (21) movably suspending the fixing belt (20) therebetween; and a magnetization means (24) for heating the heat-generating roller (21) through magnetization, which is arranged outside the heat-generating roller (21). In this image heating device, the magnetization means (24) heats the heat-generating roller (21) through magnetization after a rotating operation of the heat-generating roller (21) is started.

26 Claims, 24 Drawing Sheets

(a)

(b)

IMAGE HEATING DEVICE AND IMAGE FORMING APPARATUS USING THE SAME

TECHNICAL FIELD

The present invention relates to an image heating device permitting reduction of warm-up time and an image forming apparatus. More particularly, the present invention relates to an image heating device for use in image forming apparatus, such as electrophotographical apparatus or electrostatic recording apparatus, that is suitable as a fixing device for fixing unfixed images, and to an image forming apparatus.

BACKGROUND ART

Conventionally, as image heating devices, for which fixing devices are a typical example, contact-heating devices such as heat roller type devices and belt type devices, generally have been used.

In recent years, due to the demand for shorter warm-up time and reduced energy consumption, electromagnetic induction heating, by which rapid heating and high efficiency heating are likely to be attained, are attracting great attention (see JP 10(1998)-123861 A).

FIG. 23 shows a cross-sectional view of an image heating device utilizing the electromagnetic induction, which is disclosed in JP 10(1998)-123861 A. As shown in FIG. 23, a magnetization coil 114 is provided inside a heat-generating roller 112. By this magnetization coil 114 and a core 117, an alternating magnetic field is generated to induce an eddy current in the heat-generating roller 112, thereby heating the heat-generating roller 112. Then, an unfixed toner image 111 formed on recording paper 110 can be fixed after the recording paper 110 has passed through a nip portion formed between the heat-generating roller 112 and a pressure roller 113. Further, an image heating device with a heat-generating roller that is made thin has been proposed, as disclosed in JP 10(1998)-74007 A. FIG. 24 shows this device.

In FIG. 24, reference numeral 310 denotes a magnetization coil, which generates a high-frequency field when a high-frequency current is applied thereto from an inverter circuit, and reference numeral 311 denotes a metal sleeve, which generates heat through electromagnetic induction and is rotated. An external pressure member 313 rotates in arrow direction "a". The metal sleeve 311, which is held between the external pressure member 313 and an internal pressure member 312, rotates following the external pressure member 313.

A recording paper 314 carrying an unfixed toner image thereon is fed to the nip portion formed between the external pressure member 313 and the internal pressure member 312 in the arrow direction shown in the drawing. The unfixed toner image on the recording paper 314 is then fixed by the heat from the metal sleeve 311 and the pressure from both the pressure members 312 and 313.

Further, to prevent electromagnetic induction heating from being performed while the metal sleeve 311 is at rest, a heating signal for the inverter circuit is set to be a logical product of an operation signal and a heating signal from a drive motor for rotating the external pressure member 313.

In image heating devices utilizing such electromagnetic induction, a heat-generating member such as a heat-generating roller or the like is directly heated through electromagnetic induction. Such image heating devices thus can attain higher heat-exchanging efficiency as compared with those using a halogen lamp for heating, so that the surface of a fixing roller can be heated up to a fixing temperature rapidly with a smaller power.

However, the image heating device in which a normal metal heat-generating roller is simply heated through electromagnetic induction cannot attain remarkably reduced warm-up time as compared with conventional image heating devices using a halogen lamp for heating.

Further, if a heat generating roller is made thinner to decrease the thermal capacity for shortening warm-up time, it becomes difficult to control the temperature of the roller.

JP 8(1996)-137306 A has proposed an image heating device using a belt with a smaller thermal capacity for shortening warm-up time. In this image heating device, the belt formed of a conductive material is heated through electromagnetic induction and the belt itself thus can be heated rapidly. However, since the thermal capacity of the belt is too small, the heat generated by the belt is removed by a tension roller and an oil roller, which brings about a problem that it is difficult to raise the temperature of the entire system.

For shortening warm-up time, a rotating operation of the heat-generating roller is generally started after the heat-generating roller is heated up to a predetermined temperature. However, since the roller can be heated rapidly according to the electromagnetic induction heating, if the heat-generating roller at rest is heated in the image heating device with a small thermal capacity, an abrupt temperature rise may occur at a portion of the heat-generating roller. This may result in deterioration of the belt, an elastic material provided on the belt, and the like.

Especially in an image heating device performing heating with a heat-generating roller and a heat-resistant belt looped around the roller, the temperature of the heat-generating roller is made too high by the rapid heating, resulting in permanent set of the heat-resistant belt in accordance with the curvature of the roller. It is to be noted here that this problem seldom occurs in the case of a conductive belt and never occurs in an image heating device in which a straight portion of the belt is heated. This problem occurs only in an image heating device in which a heat generating roller is heated and the heat from the roller is conveyed by the belt formed of a resin.

From the viewpoint of saving energy, it is preferable that a heat-generating member in an image heating device is heated only when the device is used. Image heating devices of heat roller type generally include a heat-generating member in a nip portion. However, in image heating devices of the belt type, a heat-generating member is away from a nip portion, resulting in time lag between the temperature change in the heat-generating member and in the nip portion.

In addition, in the image heating devices in which the heat-generating member is away from the nip portion, the heat from the belt, which has been heated by the heat-generating member, is not only consumed for melting toner on recording paper but also for heating a pressure roller and a fixing roller. The pressure roller and the fixing roller are heated by removing the heat from the belt. Accordingly, the amount of the heat removed by these rollers depends on the amount of the belt that has been passed, i.e., the process speed. The heat removed by these rollers is not directly involved in the fixing operation. Therefore, it is necessary to minimize the amount of this wasted heat for performing the fixing operation quickly.

In an image heating device including a magnetization coil and a rotatable conductive heating element, if the device is configured so that the conductive heating element is heated through electromagnetic induction only when the element is rotating, the magnetization coil should magnetize the element after a rotating operation of the element is started. Otherwise, the temperature of the element is only partially made high, resulting in uneven temperature distribution. Although this configuration permits a relatively short warm-up time, it is necessary that the conductive heating element keeps residual heat during a standby period for immediately satisfying the user's demands for printing. However, in the image heating device with this configuration, a rotating operation of the conductive heating element has to be performed for heating the element, which brings about a problem that the element needs to be kept rotating even in the standby period. Besides, since the conductive heating element is heated rapidly, it is difficult to maintain the element at low temperatures.

In the belt-type image heating device, if a temperature sensor is provided on the surface of the belt, the sensor is liable to damage the surface of the belt, thereby reducing the life of the belt. On this account, there has been an attempt to provide the temperature sensor at a portion that is not in contact with the belt on the surface of the heat-generating roller. In this case, however, the temperature sensor cannot accurately determine the amount of the heat removed from the belt and an appropriate amount of heating thus cannot be performed. On the other hand, when the temperature sensor is merely attached to the inner peripheral surface of the belt, accurate determination of the temperature is made difficult by variations in measured temperatures due to vibration or snaking of the belt.

If the heat-generating member is heated through electromagnetic induction while it is at rest, only a portion of the heat-generating member is extremely heated up, which may exceed the heat resistant temperature of the heat-generating member or any other members in contact with the heat-generating member. This may result in thermal alteration and thermal deformation of the member(s), which cause to degrade the quality of resultant images.

In the above-mentioned image heating device, only the operation signal to the drive motor is taken into consideration. Accordingly, the device is not capable of dealing with the trouble occurring in the path for transporting the driving force from the drive motor to the image heating device. Particularly, in the image heating device configured to be freely attachable/detachable to/from the image forming apparatus main body, insufficient installation, damage to the gear for transporting the driving force from the drive motor, and the like are liable to occur, which may lead to a problem that the heat-generating member does not rotate while the drive motor is rotating.

DISCLOSURE OF INVENTION

The present invention has been made to overcome the above-mentioned problems of the prior art. It is an object of the present invention to provide an image heating device with a small capacity that can be heated rapidly and an image forming apparatus. It is a further object of the present invention to provide an image forming apparatus including an image heating device requiring a short warm-up time, which can deal with abnormal conditions and thus can be used stably.

In order to achieve the above objects, an image heating device according to a first configuration of the present invention includes a belt having a heat resistance; a rotatable heat-generating member, which is at least partially conductive and arranged in contact with an inner peripheral surface of the belt; a fixing roller, the fixing roller and the heat-generating member movably suspending the belt therebetween; and a magnetization means for heating the heat-generating member through magnetization, which is arranged outside the heat-generating member. The image heating device according to the first configuration is characterized in that the magnetization means heats the heat-generating member through magnetization after a rotating operation of the heat-generating member is started.

If the magnetization means heats the heat-generating member through magnetization before the rotating operation of the heat-generating member is started, a temperature of the heat-generating member is only partially made abnormally high, thereby causing alternation of the heat-resistant belt that is in contact with the heat-generating member, as well as permanent set of the belt in accordance with the curvature of the heat-generating member. Further, if the surface of the belt is coated with an elastic layer made of silicone rubber, for example, a temperature of the belt is only partially made high, thereby causing alternation or peeling of this elastic layer. However, in the image heating device according to the first configuration of the present invention, the problems as above never arise because the magnetization means heats the heat-generating member through magnetization after the rotating operation of the heat-generating member is started. On the other hand, in the image heating device configured so that the entire heat-generating member is heated at one time by the magnetization means provided inside the heat-generating member, it is possible to heat the heat-generating member while it is at rest. In this case, however, since a temperature of the magnetization means is made high, there is a concern about a heat resistance of the magnetization means. In contrast, in the image heating device according to the first configuration of the present invention, since the magnetization means is provided outside the heat-generating member, it is possible to cool the magnetization means.

An image heating device according to a second configuration of the present invention includes a rotatable belt having a heat resistance; a heat-generating member, which is at least partially conductive and arranged in contact with an inner peripheral surface of the belt; a fixing roller, the fixing roller and the heat-generating member movably suspending the belt therebetween; and a magnetization means for heating the heat-generating member through magnetization, which is arranged outside the heat-generating member. The image heating device according to the second configuration is characterized in that the magnetization means heats the heat-generating member through magnetization only when a rotating operation of the belt is being performed. The image heating device according to this second configuration exhibits the same effect as that in the image heating device according to the above-mentioned first configuration.

The above-mentioned first and second configurations of an image heating device according to the present invention is effective in the case where a portion of the heat-generating member to be heated by the magnetization means has a certain curvature, and the belt is heated by heat from the portion with the certain curvature.

Further, in the above-mentioned first and second configurations of an image heating device according to the present invention, it is preferable that a glass transition point of the belt is 200° C. to 500° C. When the glass transition point of the belt is less than 200° C., it is difficult to use the belt as a fixing belt. On the other hand, when the glass transition point of the belt is more than 500° C., care about heating as described above need not be taken.

Further, in the above-mentioned first and second configurations of an image heating device according to the present invention, it is preferable that not more than ⅔ of a total outer area of the heat-generating member is heated by the magnetization means. In the case where more than ⅔ of the total outer area of the heat-generating member is heated by the magnetization means, heat remaining in the magnetization means does not escape easily, which leads to the same problem about heat as that in the image heating device in which the magnetization means is provided inside the heat-generating member.

Furthermore, in the above-mentioned first and second configurations of an image heating device according to the present invention, it is preferable that a thermal capacity of the heat-generating member is not more than 60 J/K. According to this preferable example, the heat-generating member can be heated up to 200° C. or more in about one second when the heat-generating member is heated with 1000 W of electric power being applied to the heat-generating member. In practice, since heating is not performed on the entire heat-generating member, a thermal capacity of only the portion that is really heated is considered to be not more than half the above-mentioned value. Accordingly, it is considered that the heat-generating member can be heated up to 400° C. or more in about one second. This becomes increasingly significant as the heat-generating member is made thinner. Accordingly, if heating by the magnetization means is started first, a rotating operation needs to be started in one second. In addition, in the case where the thermal capacity of the heat generating member is not more than 30 J/K, the heat-generating member can be heated up to hundreds of degrees in one second when the heat-generating member is heated with 500 W of electric power being applied to the heat-generating member. Moreover, when the thermal capacity of the heat-generating member is not more than 20 J/K, the heat-generating member may be heated up to hundreds of degrees in a moment. Therefore, it is essential that the heat-generating member or the belt is rotated.

Still further, in the above-mentioned first and second configurations of an image heating device according to the present invention, it is preferable that the magnetization means is a magnetization coil.

In the above-mentioned first configuration of an image heating device according to the present invention, it is preferable that the rotating operation of the heat-generating roller is terminated after the magnetization of the heat-generating roller by the magnetization means is terminated.

Further, in the above-mentioned first and second configurations of an image heating device according to the present invention, it is preferable that the belt is rotated at least until a furthest upstream point in a rotating direction of a portion in which the belt and the heat-generating member both at rest are in contact with each other at a certain curvature separates from the heat-generating member before heating of the heat-generating member is started. If the belt remains at rest for a long time while maintaining a certain curvature, the belt may be deformed temporarily in accordance with the curvature. Such deformation can be restored if the belt is rotated while being heated. However, if the belt is heated while it is at rest, the belt is liable to be permanently set. Therefore, heating of the heat-generating member needs to be started after the portion of the belt that is in contact with the heat-generating member when the belt is at rest and is deformed in accordance with a certain curvature separates from the heat-generating member.

An image heating device according to a third configuration of the present invention includes a belt having a heat resistance; a first support roller arranged in contact with an inner peripheral surface of the belt; a second support roller, the second support roller and the first support roller movably suspending the belt therebetween; and a magnetization means for heating at least one of the first support roller and the belt through magnetization. The image heating device according to the third configuration is characterized in that the belt is rotated at least until a furthest upstream point in a rotating direction of a portion in which the belt and the first support roller both at rest are in contact with each other at a certain curvature separates from the first support roller before heating of the heat-generating member is started.

An image heating device according to a fourth configuration of the present invention includes a belt having a heat resistance; a rotatable heat-generating member, which is at least partially conductive and arranged in contact with-an inner peripheral surface of the belt; a fixing roller, the fixing roller and the heat-generating member movably suspending the belt therebetween; a pressure roller arranged in opposition to the fixing roller, the pressure roller and the belt forming a nip portion therebetween; and a magnetization means for heating the heat-generating member through magnetization, which is arranged outside the heat-generating member. The image heating device according to the fourth configuration is characterized in that heating of the heat-generating member by the magnetization means is terminated while a recording material is passing through the nip portion.

In the case of an image heating device of belt type, a heat-generating member is away from a nip portion. Accordingly, if the heating of the heat-generating member by the magnetization means is terminated after the recording material has passed through the nip portion, time lag is generated between the temperature change in the heat-generating member and in the nip portion. In order to terminate heating immediately after fixing is completed from the viewpoint of saving energy, it is necessary to terminate the heating of the heat-generating member by the magnetization means when a distance between the nip portion and a terminal end of the recording material becomes shorter than a distance between a point where the belt separates from the heat-generating member and the nip portion. By doing so, heating can be terminated when the belt has stored a sufficient amount of heat for melting toner on the recording material.

An image heating device according to a fifth configuration of the present invention includes a magnetization means; and a rotatable conductive heat-generating body to be heated by the magnetization means, with the magnetization means heating the conductive heat-generating body through magnetization after a rotating operation of the conductive heat-generating body is started. The image heating device according to the fifth configuration is characterized in that the conductive heat-generating body is rotated at a first speed when a temperature thereof is less than a predetermined set temperature and at a second speed when a temperature thereof is not less than the predetermined set temperature. This is because the time required for raising temperatures varies depending on rotational speeds. To shorten the time required for raising temperatures, it is important to prevent the heat of heat-generating body from being removed by other members as well as to increase the speed at which the conductive heat-generating body is heated. A typical example of members removing the heat from the conductive heat-generating body is a pressure roller. When the pressure roller is at rest, the pressure roller removes only a small amount of heat from the conductive heat-generating body because it removes heat only from the portion contacting the fixing roller. However, when the pressure roller is rotating, the entire pressure roller removes heat from the conductive heat-generating body. Accordingly, the amount of heat removed by the pressure roller increases in accordance with increase in the rotational speed of the pressure roller. On this account, by rotating the conductive heat-generating body at a low speed when raising the temperature of the conductive heat-generating body and then changing the speed to a normal speed (i.e., the speed at the time of routine operations) when the temperature of the conductive heat-generating body has reached a predetermined temperature, the time required for raising the temperature can be shortened.

In the case of an image heating device of belt type including a fixing roller and a pressure roller, a more significant effect can be obtained because the fixing roller also removes heat from the conductive heat-generating body.

In OHP mode, fixing is performed at a speed of not more than half the normal speed. In addition, in the OHP mode, since a transmittance varies considerably as affected by a temperature of the pressure roller, it is necessary that the pressure roller also be heated. In OHP mode, if the conductive heat-generating body is operated at a speed of half the normal speed from the beginning, the temperature rise in the pressure roller is made slow. However, by rotating the conductive heat-generating body at the normal speed when heating the conductive heat-generating body and then reducing the speed to half the normal speed when the temperature of the conductive heat-generating body has reached a predetermined temperature, the heat-generating body can be rapidly heated up to a fixing temperature at which a sufficient OHP transmittance is obtained.

Further, in the above-mentioned fifth configuration of an image heating device according to the present invention, it is preferable that the magnetization means is a magnetization coil for heating the conductive heat-generating body through magnetization, which is arranged outside the conductive heat-generating body.

Furthermore, in the above-mentioned fifth configuration of an image heating device according to the present invention, it is preferable that the image heating device further includes a belt formed of a heat-resistant resin, whose inner peripheral surface is in contact with the conductive heat-generating body; and a fixing roller, the fixing roller and the conductive heat-generating body movably suspending the belt therebetween.

Still further, in the above-mentioned fifth configuration of an image heating device according to the present invention, it is preferable that the first speed is not more than ⅔ of the second speed.

An image heating device according to a sixth configuration of the present invention includes a magnetization means; and a rotatable conductive heat-generating body to be heated by the magnetization means, the magnetization means heating the conductive heat-generating body through magnetization after a rotating operation of the conductive heat-generating body is started, the rotating operation of the conductive heat-generating body being terminated after the heating of the conductive heat-generating body by the magnetization means is terminated. The image heating device according to the sixth configuration is characterized in that the conductive heat-generating body is rotated at a speed slower than that at a time of routine operations during a standby period.

In an image heating device according to the present invention, to further shorten the elapsed time until printing is completed, it is necessary that the image heating device keeps residual heat even in a standby period. However, in the image heating device according to the present invention, it is difficult to raise the temperature of an fixing unit while maintaining the unit at rest, as performed in the conventional image heating device using a halogen lamp for heating. A rotating operation is thus required even when the image heating device maintains residual heat. However, if the same operation as that during routine operations is performed during a standby period, it is too noisy and the life of the image heating device is shortened. On this account, during a standby period, it is necessary to rotate the conductive heat-generating body at a speed slower than that at a time of routine operations.

Further, in the above-mentioned sixth configuration of an image heating device according to the present invention, it is preferable that the magnetization means is a magnetization coil for heating the conductive heat-generating body through magnetization, which is arranged outside the conductive heat-generating body.

Furthermore, in the above-mentioned sixth configuration of an image heating device according to the present invention, it is preferable that the image heating device further includes a belt formed of a heat-resistant resin, whose inner peripheral surface is in contact with the conductive heat-generating body; and a fixing roller, the fixing roller and the conductive heat-generating body movably suspending the belt therebetween.

Still further, in the above-mentioned sixth configuration of an image heating device according to the present invention, it is preferable that the conductive heat-generating body is rotated at a speed not more than ½ of a speed at a time of routine operations during a standby period. When the maximum electric power is applied to the conductive heat-generating body, the temperature of the conductive heat-generating body is raised abruptly. Accordingly, when the conductive heat-generating body maintains residual heat, the reduced electric power should be applied to the heat-generating body.

Still further, in the above-mentioned sixth configuration of an image heating device according to the present invention, it is preferable that the conductive heat-generating body is rotated intermittently during a standby period.

Still further, in the above-mentioned sixth configuration of an image heating device according to the present invention, it is preferable that the conductive heat-generating body starts to rotate when a temperature thereof becomes less than a first set temperature and stops rotating immediately or after an elapse of a certain time period when a temperature thereof becomes not less than a second set temperature.

As described above, while the heat-generating body keeps residual heat, it is not necessary to operate the conductive heat-generating member continuously. It is sufficient that the conductive heat-generating member starts to rotate when a temperature thereof becomes less than a predetermined first temperature and stops rotating when a temperature thereof becomes not less than a predetermined second temperature. The rotating operation may be stopped immediately after the heating is stopped. However, it is preferable that the rotating operation is stopped after an elapse of a certain time period after the heating is stopped. This can be a measure for the case where there is a small amount of overshoot after the heating is stopped.

Still further, in the above-mentioned sixth configuration of an image heating device according to the present invention, it is preferable that, during a standby period, an output lower than that during a warm-up period is applied to the magnetization means.

An image heating device according to a seventh configuration of the present invention includes a belt having a heat resistance; a rotatable heat-generating member arranged in contact with an inner peripheral surface of the belt; a fixing roller, the fixing roller and the heat-generating member movably suspending the belt therebetween; and a pressing member arranged in contact with an outer peripheral surface of the belt. The image heating device according to the seventh configuration is characterized in that a temperature sensor is provided so as to be in contact with an inner peripheral surface of the belt and in opposition to the pressing member between the heat-generating member and the fixing roller.

In an image heating device of belt type, temperature measurement preferably is performed in a portion between the nip portion and the heat-generating member to reflect the amount of heat removed by fixing. However, if the temperature sensor is pressed against the surface of the belt, which is made thin, the surface of the belt is damaged to reduce the life thereof, thereby causing defective images to be obtained. On this account, it is preferable that the temperature sensor is pressed against the rear surface of the belt. In this case, however, the temperature sensor cannot perform accurate temperature measurement without a pressing member opposing the temperature sensor via the belt, due to vibration or snaking of the belt. Therefore, by providing the temperature sensor on the side of the rear surface of the belt so as to oppose a member pressing the belt on the side of the surface of the belt, e.g., an oil application roller or a cleaning roller, the temperature sensor can perform accurate temperature measurement without damaging the belt. In the image heating devices employing electromagnetic induction heating, rapid heating and subtle temperature control can be performed. In such devices, this configuration is more effective since temperature measurement of the belt thus becomes important.

Further, in the above-mentioned seventh configuration of an image heating device according to the present invention, it is preferable that the image heating device further includes a magnetization means arranged outside the heat-generating member; the heat-generating member being at least partially conductive, the heat-generating member being heated by the magnetization means through electromagnetic induction.

An image forming apparatus according to a first configuration of the present invention includes an image forming means for forming an unfixed image onto a recording material and having the unfixed image carried thereon; and a fixing device for fixing the unfixed image onto the recording material. The image forming apparatus according to the first configuration is characterized in that an image heating device as described above is used as the fixing device.

An image forming apparatus according to a second configuration of the present invention includes a heat-generating member; a magnetization coil for heating the heat-generating member through electromagnetic induction, which is arranged in opposition to the heat-generating member; an inverter circuit for supplying a high-frequency current to the magnetization coil; a control unit for controlling an operation of the inverter circuit; and a temperature sensor for transmitting a signal for temperature control to the control unit, which is arranged in the heat-generating member at a portion other than a portion that is heated most by the magnetization coil.

When the temperature sensor is provided in the heat-generating member on the surface opposing the magnetization means, which is the portion heated most in the heat-generating member, the heat-generating member and the magnetization coil are spaced away, resulting in a degraded electromagnetic coupling between the heat-generating member and the magnetization coil. On the other hand, when the magnetization coil is formed in a shape avoiding the temperature sensor, the amount of the heat generated from the heat-generating member decreases only at the portion where the temperature sensor is provided, resulting in uneven temperature distribution.

Further, in the above-mentioned second configuration of an image forming apparatus according to the present invention, it is preferable that the image forming apparatus further includes a driving source for rotationally driving the heat-generating member; and a rotation detecting means for detecting rotation of the heat-generating member, the heat-generating member being rotatable, the magnetization coil being arranged in opposition to a peripheral surface of the heat-generating member.

Furthermore, in the above-mentioned second configuration of an image forming apparatus according to the present invention, it is preferable that the image forming apparatus further includes a rotatable member, which rotates while keeping in contact with the heat-generating member; a driving source for rotationally driving the rotatable member; and a rotation detecting means for detecting rotation of the rotatable member, the heat-generating member being at least partially formed of a conductive material.

Still further, in the above-mentioned second configuration of an image forming apparatus according to the present invention, it is preferable that the image forming apparatus further includes a rotatable member, which rotates while keeping in contact with the heat-generating member; a driving source for rotationally driving one of the heat-generating member and the rotatable member without using the other; a rotation detecting means for detecting rotation of the heat-generating member or the rotatable member, the heat-generating member being rotatable, the magnetization coil being arranged in opposition to a peripheral surface of the heat-generating member.

Still further, in the above-mentioned second configuration of an image forming apparatus according to the present invention, it is preferable that the image forming apparatus further includes a rotatable member, which rotates while keeping in contact with the heat-generating member; a driving source for rotationally driving one of the heat-generating member and the rotatable member without using the other; a driven member, which is driven via the heat-generating member or the rotatable member, and a rotation detecting means for detecting rotation of the driven member, the heat-generating member being rotatable, the magnetization coil being arranged in opposition to a peripheral surface of the heat-generating member.

Further, it is preferable that an operation of the inverter circuit is started by the control unit after a detecting signal is produced by the rotation detecting member.

Furthermore, it is preferable that an operation of the inverter circuit is stopped by the control unit when a signal from the rotation detecting member is not obtained for a predetermined time period.

Still further, it is preferable that rotation of the heat-generating member and the rotatable member is performed along with an operation of the inverter circuit.

Further, in the above-mentioned second configuration of an image forming apparatus according to the present invention, it is preferable that the image forming apparatus further includes a fixing unit comprising the heat-generating member and the fixing unit is freely attachable/detachable to/from an image forming apparatus main body.

An image forming apparatus according to a third configuration of the present invention includes a fixing belt; first and second support rollers for rotatably supporting the fixing belt; a magnetization coil for heating at least one of the first support roller and the fixing belt through electromagnetic induction, which is arranged in opposition to the fixing belt looped around the first support roller; an inverter circuit for supplying a high-frequency current to the magnetization coil; a control unit for controlling an operation of the inverter circuit; and a temperature sensor for transmitting a signal for temperature control to the control unit, which is arranged in at least one of the first support roller and the fixing belt at a portion other than a portion that is heated most by the magnetization coil.

Further, in the above-mentioned third configuration of an image forming apparatus according to the present invention, it is preferable that the image forming apparatus further includes a pressure member, which rotates while being pressed against the second support roller via the fixing belt; a driving means for rotationally driving the pressure member; and a rotation detecting means for detecting rotation of the pressure member.

Furthermore, in the above-mentioned third configuration of an image forming apparatus according to the present invention, it is preferable that the image forming apparatus further includes a driving means for rotationally driving at least one of the first support roller and the second support roller without using the fixing belt; and a rotation detecting means for detecting rotation of the support roller that is driven by the driving means.

Still further, in the above-mentioned third configuration of an image forming apparatus according to the present invention, it is preferable that the image forming apparatus further includes a pressure member, which rotates while being pressed against the second support roller via the fixing belt; a driving means for rotationally driving one of the first support roller and the second support roller without using the fixing belt; and a rotation detecting means for detecting rotation of the support roller that is rotationally driven via rotation of the fixing belt.

Still further, in the above-mentioned third configuration of an image forming apparatus according to the present invention, it is preferable that the image forming apparatus further includes a pressure member, which rotates while being pressed against the second support roller via the fixing belt; a driving means for rotationally driving one of the first support roller and the second support roller without using the fixing belt; and a rotation detecting means for detecting rotation of the pressure member.

Further, it is preferable that the support roller that is rotated without using the fixing belt does not generate heat.

Furthermore, in the above-mentioned third configuration of an image forming apparatus according to the present invention, it is preferable that the image heating device further includes a pressure member, which rotates while being pressed against the second support roller via the fixing belt; a driving means for rotationally driving the pressure member; and a rotation detecting means for detecting rotation of a member that rotates following the pressure member.

Further, it is preferable that an operation of the inverter circuit is started by the control unit after a detecting signal is produced by the rotation detecting means.

Furthermore, it is preferable that an operation of the inverter circuit is stopped by the control unit when a signal from the rotation detecting means is not obtained for a predetermined time period.

Further, in the above-mentioned third configuration of an image forming apparatus according to the present invention, it is preferable that the image forming apparatus further includes a fixing unit comprising the fixing belt, the first and second support rollers and the fixing unit is freely attachable/detachable to/from an image forming apparatus main body.

An image forming apparatus according to a fourth configuration of the present invention includes a heat-generating member, which is at least partially formed of a conductive material; a rotatable detecting member; a magnetization coil for heating the heat-generating member through electromagnetic induction, which is arranged in opposition to a peripheral surface of the heat-generating member; an inverter circuit for supplying a high-frequency current to the magnetization coil; a control unit for controlling an operation of the inverter circuit; a temperature sensor for transmitting a signal for temperature control to the control unit, which is arranged in the heat-generating member at a portion other than a portion that is heated most by the magnetization coil; a rotating means for rotationally driving the rotatable detecting member directly or indirectly; and a rotation detecting means for detecting rotation of the rotatable detecting member. The image forming apparatus according to the fourth configuration is characterized in that a fixing unit comprising at least the heat-generating member and the rotatable detecting member is freely attachable/detachable to/from an image forming apparatus main body.

Further, in the above-mentioned fourth configuration of an image forming apparatus according to the present invention, it is preferable that the rotation detecting means is provided in the fixing unit.

Further, in the above-mentioned fourth configuration of an image forming apparatus according to the present invention, it is preferable that the rotation detecting means is provided in the image forming apparatus main body.

BEST MODE FOR CARRYING OUT THE INVENTION

Hereinafter, the present invention will be described more specifically by way of embodiments.

[First Embodiment]

Figure 1:
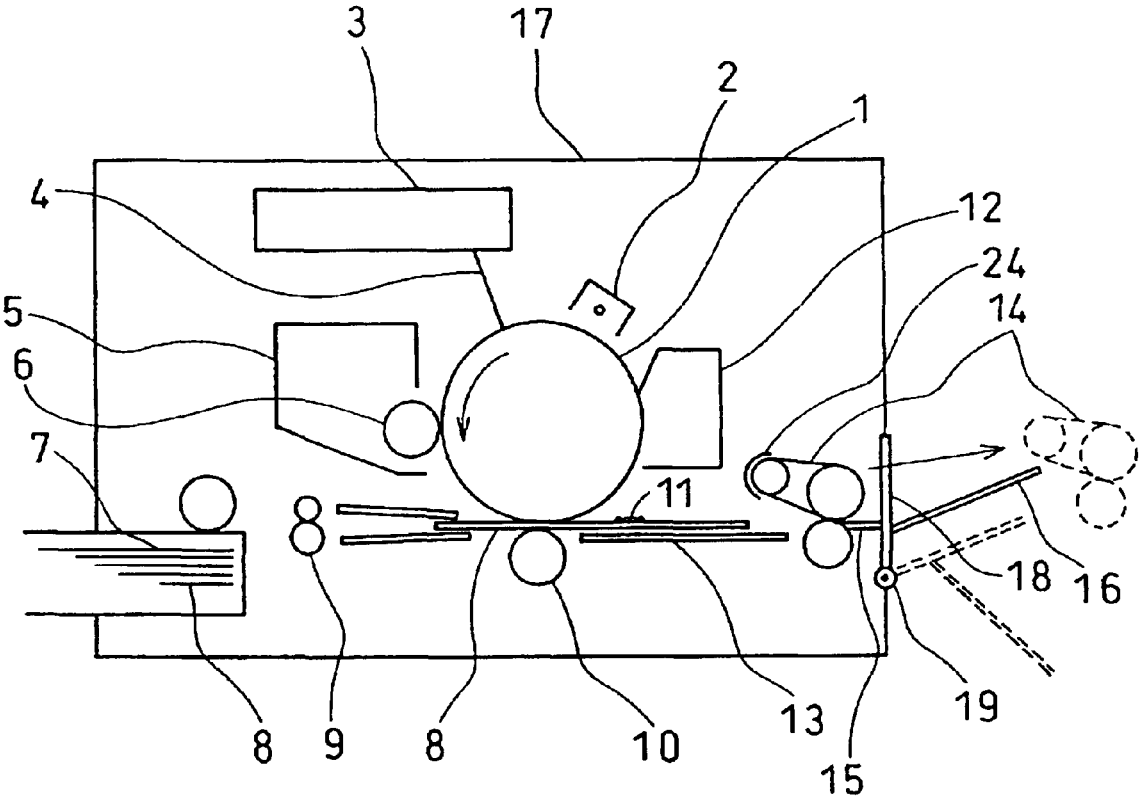
FIG. 1 is a cross-sectional view showing an image forming apparatus using as a fixing device an image heating device according to a first embodiment of the present invention.

FIG. 1 is a cross-sectional view showing an image forming apparatus using as the fixing device an image heating device according to the first embodiment of the present invention. The configuration and operation of this device will-be described in the following.

In FIG. 1, reference numeral 17 denotes an outer shell for an image forming apparatus main body and reference numeral 1 denotes an electrophotographic photoreceptor (hereinafter referred to as "photosensitive drum"). While this photosensitive drum 1 is rotationally driven at a predetermined peripheral speed in the arrow direction, its surface is charged homogeneously to a predetermined negative dark potential V0 by a charger 2.

Reference numeral 3 denotes a laser beam scanner, which outputs a laser beam 4 that is modulated in accordance with a time-series electric digital image signal of image information that is input from a host device (not shown in the drawings) such as an image reading device or a computer. The surface of the photosensitive drum 1, which has been charged homogeneously as described above, is scanned and exposed by the laser beam 4, and the absolute potential of the exposed portion is decreased to the light potential VL. Thus, an electrostatic latent image is formed on the surface of the photosensitive drum 1. This electrostatic latent image is then reversely developed with negatively charged toner using in a developing device 5 and made manifest.

The developing device 5 includes a developing roller 6. The developing roller 6 is driven rotationally and arranged in opposition to the photosensitive drum 1. On an outer peripheral surface of the developing roller 6, a thin layer of toner is formed. A developing bias voltage, whose absolute value is lower than the dark potential V0 and higher than the light potential VL of the photoelectric drum 1, is applied to the developing roller 6. The toner on the developing roller 6 is thus transferred only to the portion of the photosensitive drum 1 with the light potential VL, whereby the electrostatic latent image is made manifest to form a toner image 11.

On the other hand, recording paper 8 is fed one by one from a paper-feed portion 7 to a nip portion formed between the photosensitive drum 1 and a transfer roller 10 via a resist roller pair 9 with suitable timing in synchronization with the rotation of the photosensitive drum 1. Then, the toner image 11 on the photosensitive drum 1 is transferred to the recording paper 8 by the transfer roller 10 to which a transfer bias is applied.

Reference numeral 13 denotes a paper fixing guide, which guides the recording paper 8 onto which the toner image 11 has been transferred to a fixing unit 14. After the recording paper 8 carrying the transferred toner image 11 has separated from the photosensitive drum 1, it is fed into the fixing unit 14, which fixes the transferred toner image 11 onto the recording paper 8. Reference numeral 15 denotes a paper eject guide, which guides the recording paper 8 that has passed through the fixing unit 14 to the outside of the image forming apparatus. The recording paper 8 onto which the toner image 11 has been fixed is then discharged to a paper eject tray 16. Reference numeral 18 denotes a fixing door for allowing attachment/detachment of the fixing unit 14 and elimination of a paper jam. The fixing door 18 is opened and closed together with the paper eject tray 16 while rotating centered on a hinge 19. After opening the fixing door 18, the fixing unit 14 can be attached/detached to/from the image forming apparatus main body in the direction perpendicular to the axis of a heat generating roller 21 (see FIG. 2). In FIG. 1, the fixing unit 14 shown by the dashed line illustrates its position when it is detached from the image forming apparatus main body, whereas the fixing unit 14 shown by the solid line illustrates its position when it is attached to the image forming apparatus main body. As shown in FIG. 1, only the fixing unit 14 is attached/detached to/from the image forming apparatus main body while leaving a magnetization means 24 such as a magnetization coil 25 (see FIG. 2) described later in the image forming apparatus main body.

After the recording paper 8 has separated from the photosensitive drum 1, the surface of the photosensitive drum 1 is cleaned with a cleaning device 12, which removes residual material such as remaining toner so that the photosensitive drum 1 can be used repeatedly for subsequent image formation.

Hereinafter, an image heating device according to the present embodiment will be described more specifically by way of specific examples.

EXAMPLE 1

Figure 2:
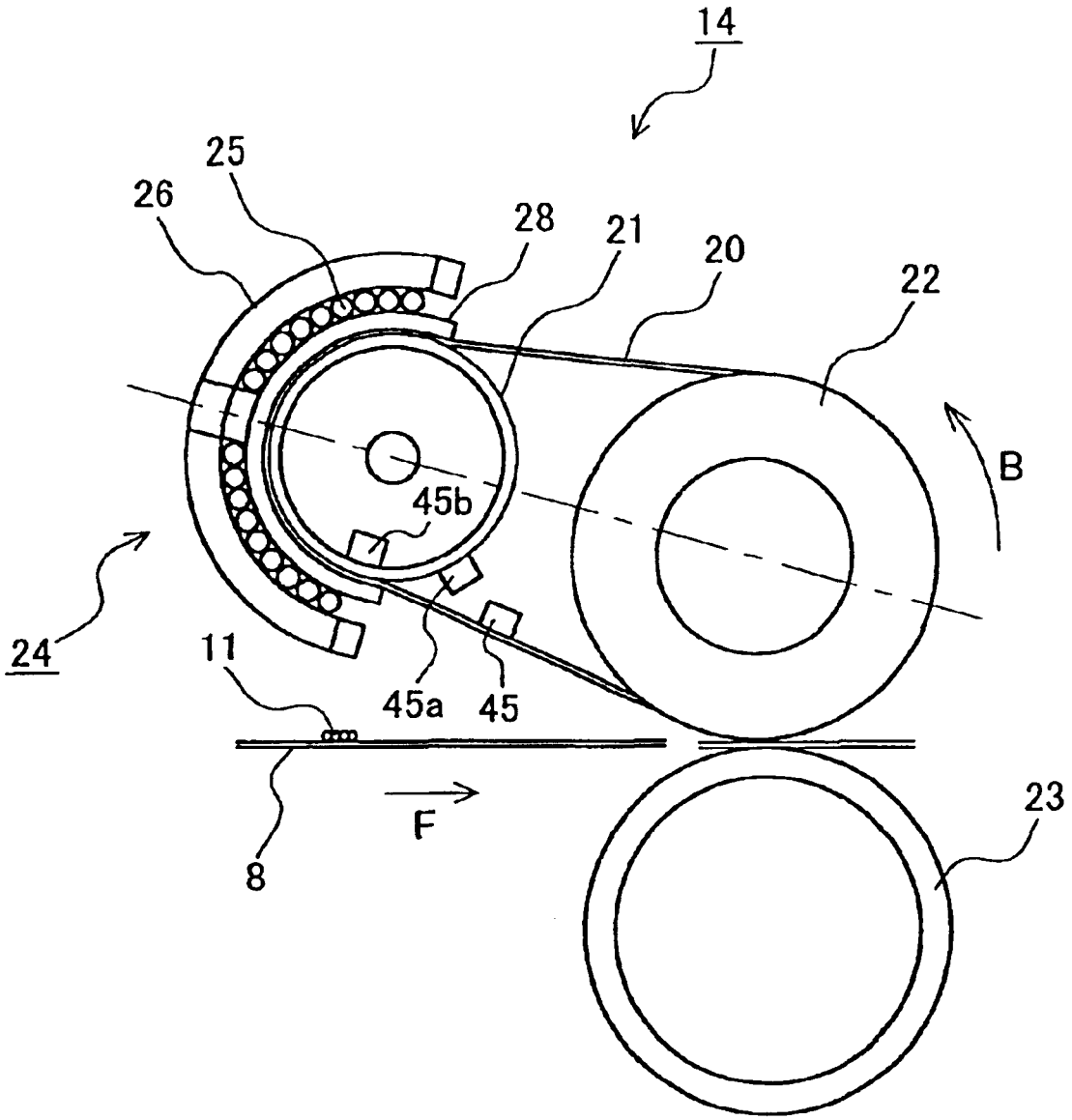
FIG. 2 is a cross-sectional view showing a fixing device serving as an image heating device in Example 1 of the present invention.

FIG. 2 is a cross-sectional view showing a fixing device serving as an image heating device in Example 1 of the present invention.

In FIG. 2, reference numeral 25 denotes a magnetization coil as a magnetization means. This magnetization coil 25 is formed using a litz wire of bundled thin wires. The cross section of the magnetization coil 25 is formed so as to cover a fixing belt 20 looped around the heat-generating roller 21. A core 26 made of ferrite is provided in the center of the magnetization coil 25 as well as in a portion of the rear surface of the magnetization coil 25. For the core 26, a material with high magnetic permeability such as permalloy also can be used in addition to ferrite. The magnetization coil 25 is provided outside the heat-generating roller 21. The heat-generating roller 21 can be heated when a portion of the heat-generating roller 21 is magnetized by the magnetization coil 25. Although the magnetization coil 25 as depicted in FIG. 2 covers and heats an about ½ of the total outer area of the heat-generating roller 21, it is to be noted here that the area of the portion to be heated should be not more than ⅔ of the total outer area of the heat-generating roller 21. If the magnetization coil 25 covers and heats more than ⅔ of the total outer area of the heat-generating roller 21, a route for conveying the fixing belt 20 cannot be ensured.

Reference numeral 28 denotes a coil guide as a supporting member. This coil guide 28 is made of a resin with a superior heat resistance, such as PEEK material or PPS, and is formed in one piece with the magnetization coil 25 and the core 26. The coil guide 28 thus provided serves to prevent the magnetization coil 25 from being damaged due to the heat generated by the heat-generating roller 21 and remaining in the space between the heat-generating roller 21 and the magnetization coil 25.

Further, although the core 26 as depicted in FIG. 2 has a semicircular cross section, it is not necessary to form the core 26 in a shape along the magnetization coil 25. For example, the core 26 may have a cross section of a substantially letter Π (Greek "pie" in upper case)-shape.

Figure 3:
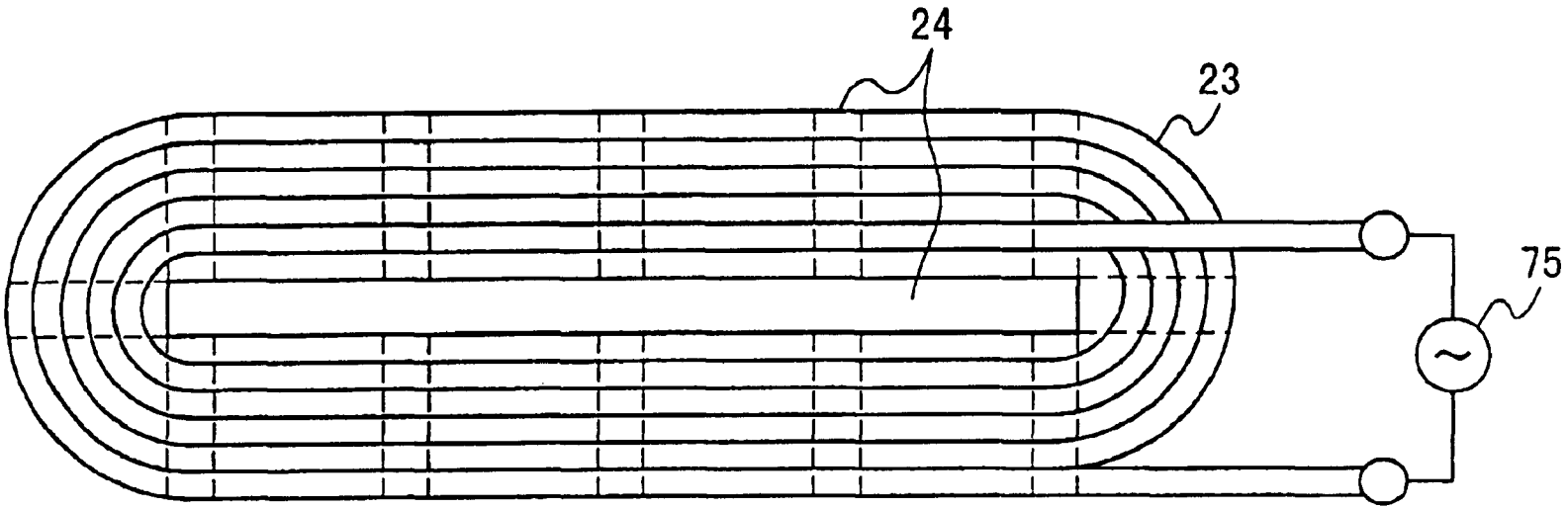
FIG. 3 is a rear view showing a configuration of a core and a magnetization coil according to Example 1 of the present invention as viewed from the side of a heat-generating roller.

FIG. 3 is a rear view showing the configuration of the core 26 and the magnetization coil 25 as viewed from the side of the heat-generating roller 21. As shown in FIGS. 2 and 3, the magnetization coil 25 extends in the direction of a rotation axis of the heat-generating roller 21 while winding around the heat-generating roller 21 in the circumferential direction of the heat-generating roller 21, so that the magnetization coil 25 is formed in a spiral shape. The core 26 is provided only in a portion of the rear surface of the magnetization coil 25 and serves to prevent magnetic flux from leaking out from the rear surface of the magnetization coil 25. A magnetizing current of 23 kHz is applied to the magnetization coil 25 from an exciting circuit 75.

In FIG. 2, the fixing belt 20, which is made thin, is an endless belt of 50 mm diameter and 90 $\mu$m thickness, which comprises a polyimide resin with a glass transition point of 360° C. as a base. The surface of the fixing belt 20 is coated with a lubricant layer (not shown in the-drawing) made of a fluorocarbon resin of 30 $\mu$m thickness for enhancing lubrication. For the base, in addition to the polyimide resin used in the present example, other resins with a heat resistance, such as a fluorocarbon resin, can be used. Preferably, the base of the fixing belt 20 has a glass transition point of 200° C. to 500° C. For the lubricant layer on the surface of the fixing belt 20, a resin or rubber with good lubrication, such as PTFE, PFA, FEP, silicone rubber, or fluorocarbon rubber may be used alone or in combination. If the fixing belt 20 is used to fix monochrome images, only lubrication has to be ensured. However, if the fixing belt 20 is used to fix color images, it is preferable that the fixing belt 20 has elasticity. In this case, it is necessary to form a thicker rubber layer.

The fixing belt 20 is suspended with a predetermined tensile force between the heat-generating roller 21 and a fixing roller 22 of 20 mm diameter with low thermal conductivity, whose surface is made of elastic foamed silicone rubber with low hardness (JIS A30 degrees), and is rotationally movable in arrow direction B.

The heat-generating roller 21 is made of SUS 430 in a cylindrical shape, which is 30 mm in diameter, 320 mm in length, and 0.5 mm in thickness. The thermal capacity of the heat-generating roller 21 is 54 J/K. For the heat-generating roller 21, in addition to SUS 430, another magnetic metal such as iron also can be used. Preferably, the thermal capacity of the heat-generating roller 21 is not more than 60 J/K.

The pressure roller 23 is made of silicone rubber with a hardness of JIS A65 degrees and pressed against the fixing roller 22 via the fixing belt 20, thereby forming a nip portion. In this state, the pressure roller 23 is supported so as to rotate following the fixing roller 22. For the pressure roller 23, a heat-resistant resin or rubber such as fluorocarbon rubber other than the silicone rubber or a fluorocarbon resin also may be used. To enhance abrasion resistance and lubrication of the pressure roller 23, it is preferable that the surface of the pressure roller 23 is coated with a resin or rubber such as PFA, PTFE, or FEP alone or in combination. Further, to avoid heat radiation, it is preferable that the pressure roller 23 is made of a material with low thermal conductivity.

The heat-generating roller 21 is rotationally driven by a driving source (not shown in the drawing) provided in the image forming apparatus main body. The fixing roller 22 rotates following the heat-generating roller 21 via the fixing belt 20. Then, the pressure roller 23 rotates following the fixing roller 22 via the fixing belt 20.

In the present example, the magnetization coil 25 heats the heat-generating roller 21 through electromagnetic induction. The mechanism thereof will be described below with reference to FIG. 4.

Figure 4:
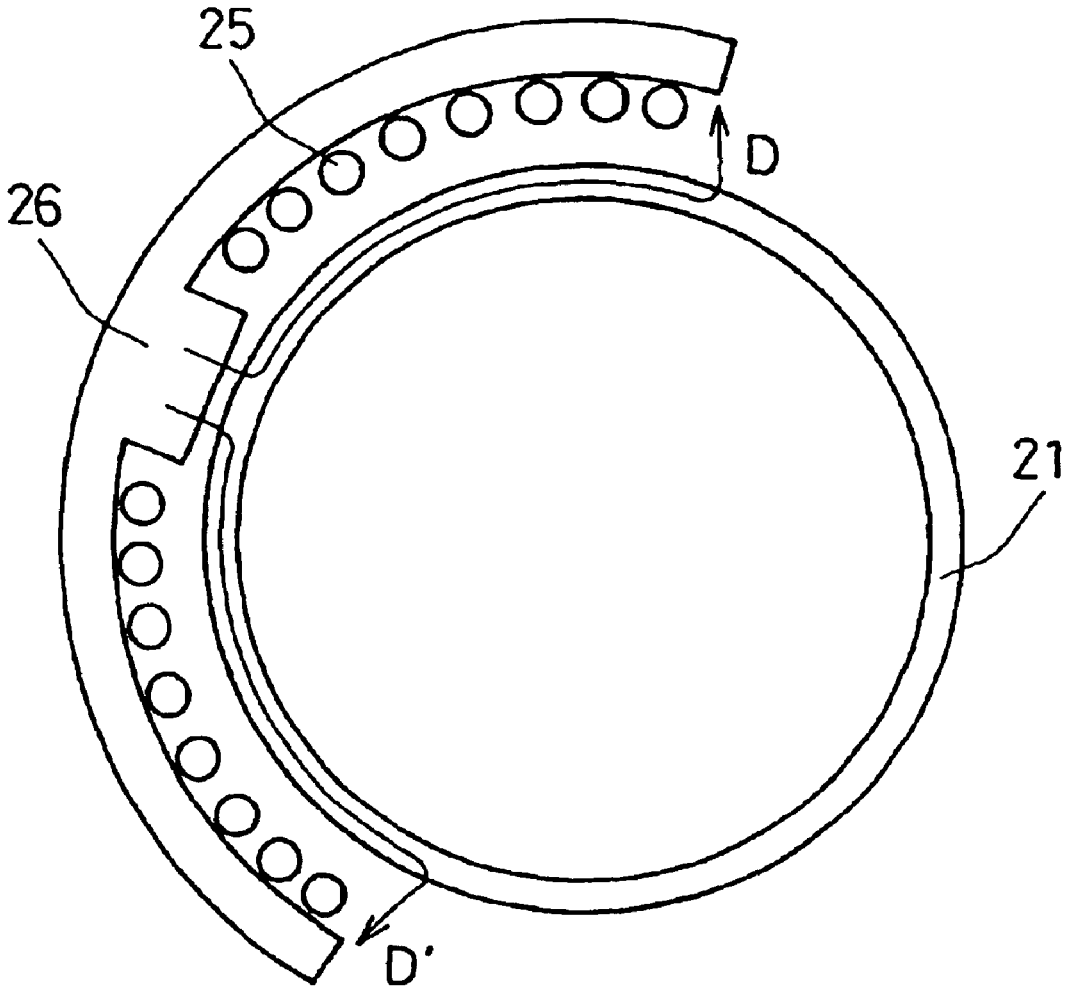
FIG. 4 is a schematic diagram illustrating a mechanism by which the magnetization coil heats the heat-generating roller through electromagnetic induction in Example 1 of the present invention

In FIG. 4, magnetic flux generated by the magnetization coil 25 penetrates the heat-generating roller 21 in its circumference direction as indicated by arrows D, D' due to the magnetism of the heat-generating roller 21 and repeats generation and annihilation. Such changes in a state of the magnetic flux induces an inducing current in the heat-generating roller 21, which mainly flows through the surface of the heat-generating roller 21 due to the skin effect, thereby causing Joule heat at the portion where it flows. The depth at which most of the inducing current flows is called a "skin depth". The skin depth is determined depending on the material through which the magnetic flux passes and the frequency of a magnetizing current. The calculated value of the skin depth is about 0.26 mm at the frequency of 23 kHz when the heat-generating roller 21 is made of SUS 430. If the thickness of the heat-generating roller 21 is equivalent to or larger than this skin depth, then the inducing current is generated almost entirely inside the heat-generating roller 21. If the frequency of the magnetizing current is increased, the skin depth decreases gradually, and a thinner heat-generating roller 21 can be used accordingly. However, if the frequency of the magnetization current is too large, costs will rise, and the noise reaching the outside becomes large.

A temperature sensor 45 is provided so as to be in contact with the rear surface of the fixing belt 20 at the portion past the contact portion in which the fixing belt 20 and the heat-generating roller 21 are in contact with each other. The temperature of the fixing belt 20 thus can be detected.

As described above, if the thickness of the heat-generating roller 21 is equivalent to or larger than the skin depth corresponding to the frequency of the magnetizing current applied to the magnetization coil 25, it becomes possible to heat the heat-generating roller 21 without generating wasted current.

A rotating operation of the fixing device with the configuration as above was started first, and then a warm-up operation was started with an electric power of 1200 W being applied to the heat-generating roller 21. About 14 seconds after starting the warming-up operation, the temperature of the fixing belt 20 at which the belt entered the nip portion reached 185° C. The recording paper 8, onto which the toner image 11 has been transferred using the image forming apparatus shown in FIG. 1, was inserted into this fixing device in arrow direction F with the side carrying the toner image 11 facing the fixing roller 22 to fix the toner image 11 on the recording paper 8, as shown in FIG. 2.

In the present example, the magnetization coil 25 heated the heat generating roller 21 after the rotating operation of the heat-generating roller 21 was started. Further, the rotating operation of the heat-generating roller 21 was terminated after the heating of the roller by the magnetization coil 25 was terminated. When the magnetization coil 25 heated the heat-generating roller 21 at rest, the temperature of the portion that is heated most reached 300° C. in a few seconds, and the base of the fixing belt 20, which was made of a polyimide resin, was deformed.

For shortening the warm-up time, it is advantageous that the heat-generating roller 21 has a small thermal capacity. However, the smaller the thermal capacity of the heat-generating roller 21 is, the larger the increase in the temperature of the heated portion of the roller becomes when the roller at rest is heated by the magnetization coil 25. In the present example, the problem as above never arises because the magnetization coil 25 heats the heat-generating roller 21 after the rotating operation of the roller is started. In this case, it is preferable that the fixing belt 20 is rotated at least until the furthest upstream point in the rotating direction of the portion in which the fixing belt 20 and the heat-generating roller 21 both at rest are in contact with each other at a certain curvature separates from the heat-generating roller 21 before the magnetization coil 25 starts to heat the heat-generating roller 21.

In the present example, the heat-generating roller 21 serving as a heat-generating member is provided inside the fixing belt 20 and the magnetization coil 25 and the core 26 are provided outside the fixing belt 20. According to this configuration, the magnetization coil 25 and the like can be prevented from being heated by the heat from the heat-generating member. This may result in a stable amount of heat generation.

In the standby period, the rotational speed of the heat-generating roller 21 was set to ½ of the rotational speed at the time of routine operations and the electric power applied to the heat-generating roller 21 was set to 400 W. When the temperature of the fixing belt 20 reached 100° C., the rotating operation and heating of the heat-generating roller 21 were started at the same time. When the temperature of the fixing belt 20 reached 120° C., the heating of the heat-generating roller 21 was stopped and then, the rotating operation of the heat-generating roller 21 was stopped after 2 seconds. According to this operation during the standby period, the temperature of the fixing belt 20 at which the belt entered the nip portion reached 185° C. from the residual heat within 5 seconds. Preferably, the rotational speed of the heat-generating roller 21 during the standby period was not more than ½ of the rotational speed at the time of routine operations.

Although the present example is directed to the configuration in which the heat-generating roller 21 generates heat through electromagnetic induction, thereby indirectly heating the fixing belt 20, the present invention is not limited to this configuration. For example, it is also possible to use a conductive fixing belt 20 and heat the belt directly through electromagnetic induction. This applies throughout each example and a second embodiment described in the following.

EXAMPLE 2

Figure 5:
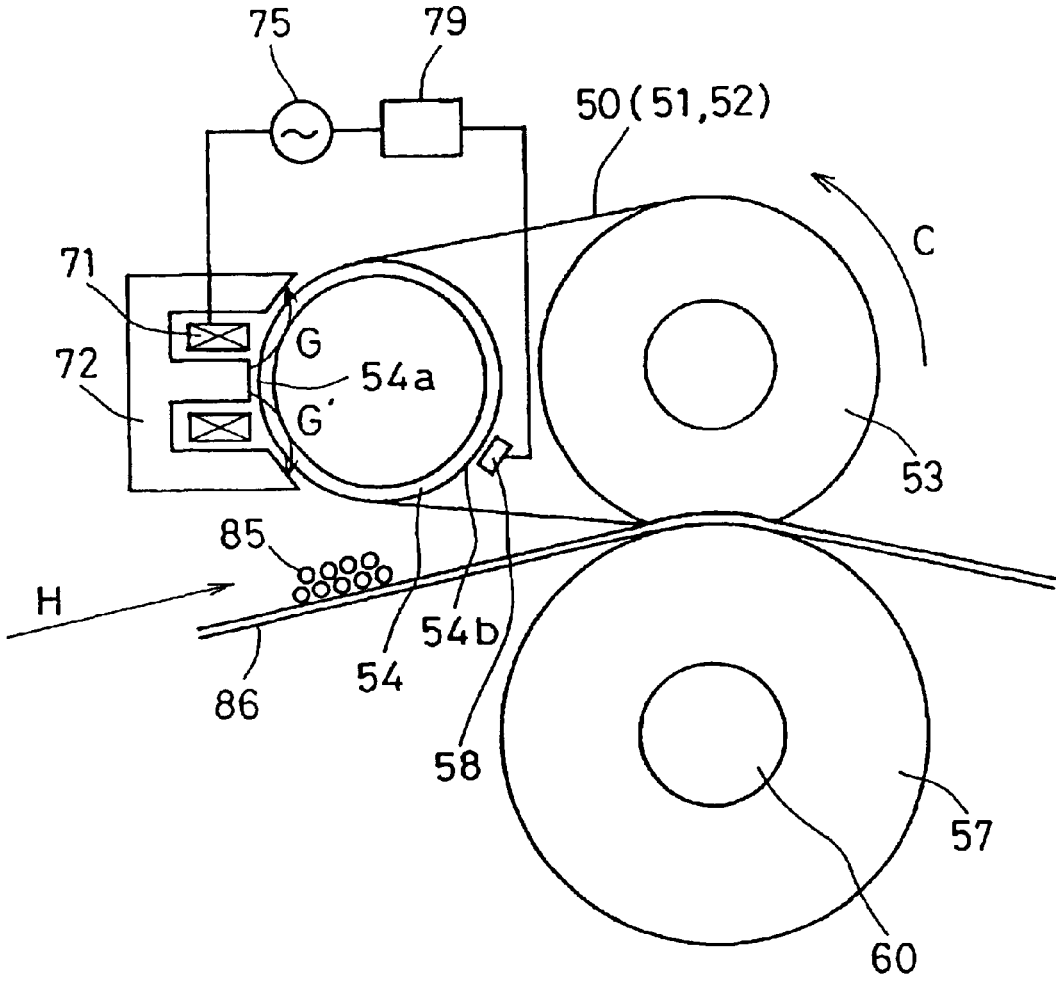
FIG. 5 is a cross-sectional view showing a fixing device serving as an image heating device in Example 2 of the present invention.

FIG. 5 is a cross-sectional view showing a fixing device serving as an image heating device in Example 2 of the present invention.

In this example, elements having the same structure and performing the same function as in the fixing device of Example 1 are referred to with the same numerals and their further explanation has been omitted.

A fixing belt 50 according to the present example is an endless belt of 60 mm diameter and 90 $\mu$m thickness, which comprises a polyimide resin with a glass transition point of 320° C. as a base 51. The surface of the fixing belt 50 is coated with silicone rubber 52 of 200 $\mu$m thickness for fixing color images. Also in this example, the heat generation is performed with a heat-generating roller 54. Accordingly, a film-shaped heat-resistant resin such as a fluorocarbon resin can be used for the fixing belt 50.

The fixing belt 50 is suspended with a predetermined tensile force between a fixing roller 53 of 30 mm diameter, which is configured similarly to that of Example 1, and the heat-generating roller 54 of 20 mm diameter, 240 mm length, and 0.4 mm thickness, and is rotationally movable in arrow direction C. The heat-generating roller 54 is made of SUS 430 and has a thermal capacity of 21 J/K.

A pressure roller 57 is made of silicone rubber with a hardness of JIS A60 degrees and pressed against the fixing roller 53 via the fixing belt 50, thereby forming a nip portion. In this state, the pressure roller 57 is supported around its metal axis 60 so as to rotate following the fixing roller 53.

A magnetization coil 71 and a core 72 are provided in opposition to the heat-generating roller 54 with a small gap therebetween via the fixing belt 50. The core 72 is formed in an E-shaped cross section, and the magnetization coil 71 is wound around the convex part in the middle of the E-shaped cross section. As in Example 1, a magnetizing current of 30 kHz is applied to the magnetization coil 71 from an exciting circuit 75, thereby causing repeated generation and annihilation of the magnetic flux as indicated by arrows G, G'. As a result, the heat-generating roller 54 is magnetized from a heat-generating portion 54*a*, at which the heat-generating roller. 54 and the fixing belt 50 are in contact with each other, as a center of magnetization, thereby causing an eddy current. When the eddy current is generated in the heat-generating roller 54, Joule heat is generated in the heat-generating roller 54 so that the heat-generating roller 54 is heated. The eddy current generated in the heat-generating roller 54 mainly passes through the portion shallower than the skin depth, which is determined depending on the magnetic permeability and specific resistance of the material used for the heat-generating roller 54 and the frequency of the magnetizing current applied to the heat-generating roller 54. From the properties of the stainless material used for the heat-generating roller 54 and the frequency of the magnetizing current, the skin depth is calculated to be about 0.3 mm. Since the thickness of the heat-generating roller 54 is set to 0.4 mm, most of the heat generation occurs in the portion of the heat-generating roller 54 between its surface and the depth determined by the skin depth. Therefore, irregularity in the thickness of the heat-generating roller 54 does not cause irregularity in heat generation. Uniform heat generation thus can be attained In addition, since the heat-generating roller 54 generates heat mainly from the surface in contact with the fixing belt 50, the heat from the heat-generating roller 54 can be transmitted to the fixing belt 50 efficiently.

On the other hand, a temperature sensor 58 is provided so as to be in contact with the surface of the heat-generating roller 54 at a portion 54*b* just past the contact portion in which the heat-generating roller 54 and the fixing belt 50 are in contact with each other. The detected output from the temperature sensor 58 controls the output from an exciting circuit 75 via a controlling means 79. The amount of the heat generated by the heat-generating roller 54 is thus controlled so that the temperature of the portion 54*b* just past the contact portion in which the heat-generating roller 54 and the fixing belt 50 are in contact with each other is kept constant at all times.

A rotating operation of the fixing device with the configuration as above was started first, and then a warm-up operation was started with an electric power of 800 W being applied to the heat-generating roller 54. About 15 seconds after starting the warming-up operation, the temperature of the fixing belt 50 at which the belt entered the nip portion reached 185° C. The time period of about 15 seconds is equivalent to the time required for printing in a color printer that prints 4 sheets/minute. Accordingly, the waiting time substantially is equal to 0.

The fixing device with the above configuration was attached to a color image forming apparatus (not shown in the drawing). Recording paper 86, onto which a color toner image 85 has been formed using a sharp-melting color toner based on polyester, was inserted into the fixing device in arrow direction H in FIG. 5, thereby fixing the color toner image 85 onto the recording paper 86.

In the present example, the heat is generated from the portion in opposition the magnetization coil 71 of the heat-generating roller 54, which is about ¼ of the total outer area of the heat-generating roller 54. Accordingly, in the case where the heat-generating roller 54 is heated while it is at rest, the heat is immediately transmitted to the fixing belt 50, resulting in deformation of the fixing belt 50 and deterioration of the silicone rubber on the surface of the fixing belt 50. Furthermore, since thermal capacity of the heat-generating roller 54 is as small as not more than 30 J/K, the heat-generating roller 54 is heated up to hundreds of degrees in a few seconds when heated at rest, thereby deforming the fixing roller 50. In the present example, the problems as above never arise because the heat-generating roller 54 is heated after the rotating operation of the roller is started.

EXAMPLE 3

Figure 6:
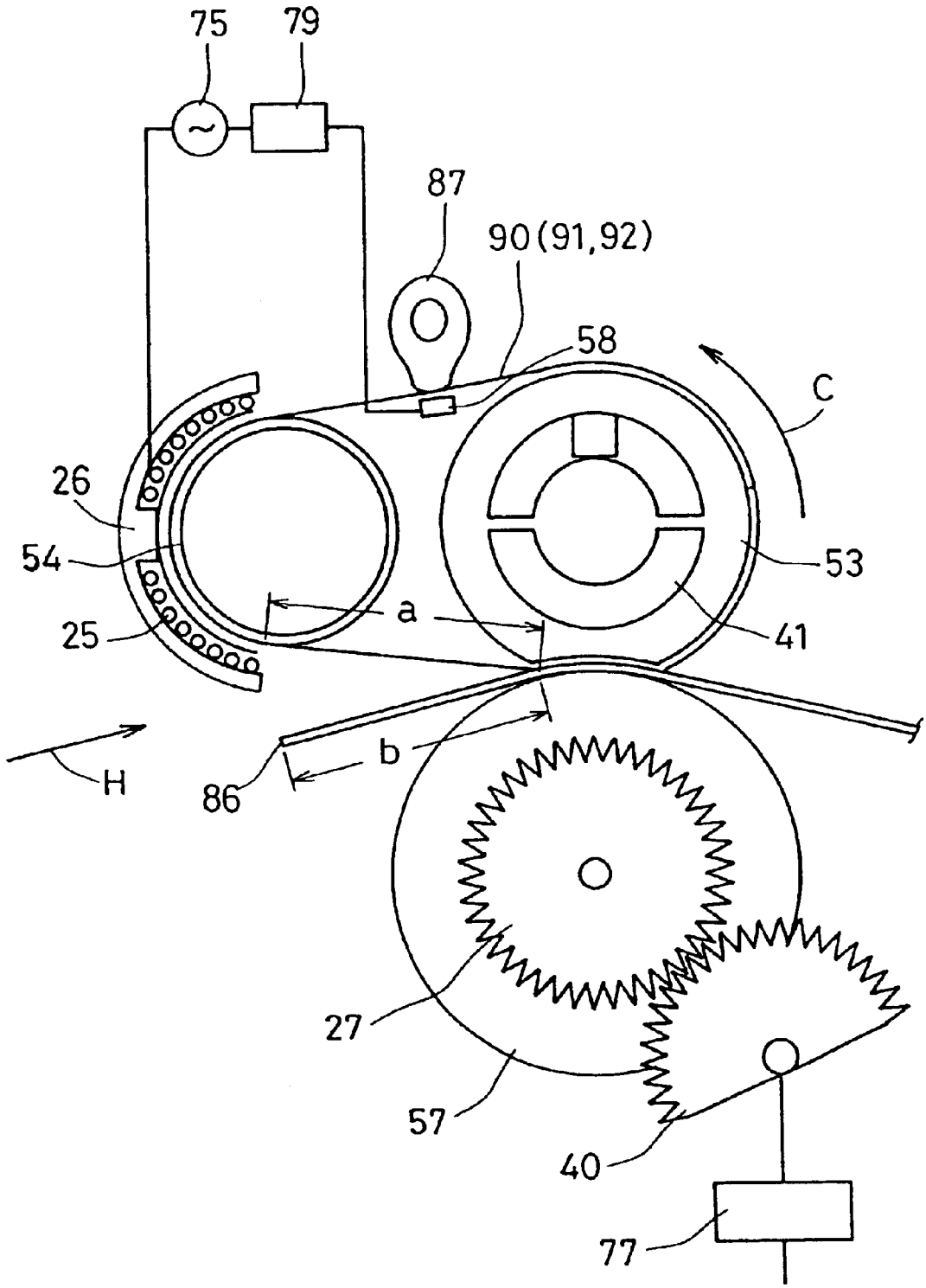
FIG. 6 is a cross-sectional view showing a fixing device serving as an image heating device in Example 3 of the present invention.

FIG. 6 is a cross-sectional view showing a fixing device serving as an image heating device in Example 3 of the present invention.

In this example, elements having the same structure and performing the same function as in the fixing devices of Examples 1 and 2 are referred to with the same numerals and their further explanation has been omitted.

A fixing belt 90 shown in FIG. 6 is a belt comprising a belt base 91 fabricated by electroforming with nickel, which is 30 μm in thickness and 60 mm in diameter, onto which silicone rubber 92 of 150 μm thickness has been formed for fixing color images.

Between a heat-generating roller 54 and a fixing roller 53, an oil application roller 87 is provided so as to be in contact with the outer peripheral surface of the fixing belt 90. Further, a temperature sensor 58 is provided in opposition to the oil application roller 87 so as to be in contact with the inner peripheral surface of the fixing belt 90. The detected output from the temperature sensor 58 controls the output from an exciting circuit 75 via a controlling means 79.

By adopting such a configuration, the temperature sensor 58 can perform an accurate temperature control without damaging the outer peripheral surface of the fixing belt 90. Although the present example is drawn to the case where the temperature sensor 58 is provided in opposition to the oil application roller 87, it is to be noted that the same effect can be obtained when, for example, a cleaning member is used in place of the oil application roller 87.

A pressure roller 57 is rotationally driven by a gear 27 fixed to an end thereof and meshing with a main body gear 40, which is rotationally driven by a stepping motor 77 provided in an image forming apparatus main body. The heat-generating roller 54 and the fixing roller 53 rotate following the fixing belt 90, which is rotated by the rotation of the pressure roller 57.

A rotation detecting plate 41 is fixed to an end of the fixing roller 53 so that the rotation of the fixing roller 53 can be detected by an optical detecting sensor.

A rotating operation of the fixing device with the configuration as above was started first, and then a warm-up operation was started with an electric power of 900 W being applied to the heat-generating roller 54. The heat-generating roller 54 was rotated with a process speed of 50 mm/s until the fixing belt 90 was heated up to 160° C. Then, when the temperature of the fixing belt 90 becomes more than 160° C., the heat-generating roller 54 was rotated at 110 mm/s, which corresponds to the speed at the time of routine operations. When the fixing belt 90 was heated with the heat-generation roller 54 being rotated at 110 mm/s, i.e., the speed at the time of routine operations, from the beginning, it took 16 seconds to heat the fixing belt 90 up to the fixing temperature, 185° C. However, when the heat-generating roller 54 was rotated at the process speed of 50 mm/s until the fixing belt 90 was heated up to 160° C. as described above, it took only 12 seconds to heat the fixing belt 90 up to the fixing temperature, 185° C. It is preferable that the speed (the first speed) at which the heat generating roller 54 is rotated when the temperature thereof is less than a predetermined set temperature (fixing temperature) is not more than ⅔ of the speed (the second speed) at which the heat generating roller 54 is rotated when the temperature thereof is more than the predetermined set temperature. The process speed can be changed by varying a frequency supplied to the stepping motor 77 connected to the main body gear 40.

Further, in OHP mode, toner images are fixed at 55 mm/s, which is half the speed at the time of routine operations. The pressure roller 57 can be heated rapidly when the heat-generating roller 54 was rotated at 110 mm/s until the fixing belt 90 was heated up to a predetermined temperature and then, the process speed of the heat-generating roller 54 is decreased to 55 mm/s when the temperature of the fixing belt 90 reaches the predetermined temperature.

In OHP mode, the temperature of the pressure roller 57 affects an OHP transmittance. However, by performing the above-mentioned operation, a sufficient transmittance can be obtained in a short time.

In the present example, the heating of the heat-generating roller 54 is terminated while recording paper 86 is passing through a nip portion formed between the fixing roller 53 and the pressure roller 57. In this case, if the heating of the heat-generating roller 54 was terminated when the distance "b" between the entrance to the nip portion and the terminal end of the recording paper 86 becomes shorter than the distance "a" between the point where the fixing belt 90 separates from the heat-generating roller 54 and the point where the fixing belt 90 enters the nip portion, the heating operation could be terminated not less than one second earlier as compared with the case where the heating of the heat-generating roller 54 was terminated after detecting ejection of the recording paper 86.

EXAMPLE 4

Figure 7:
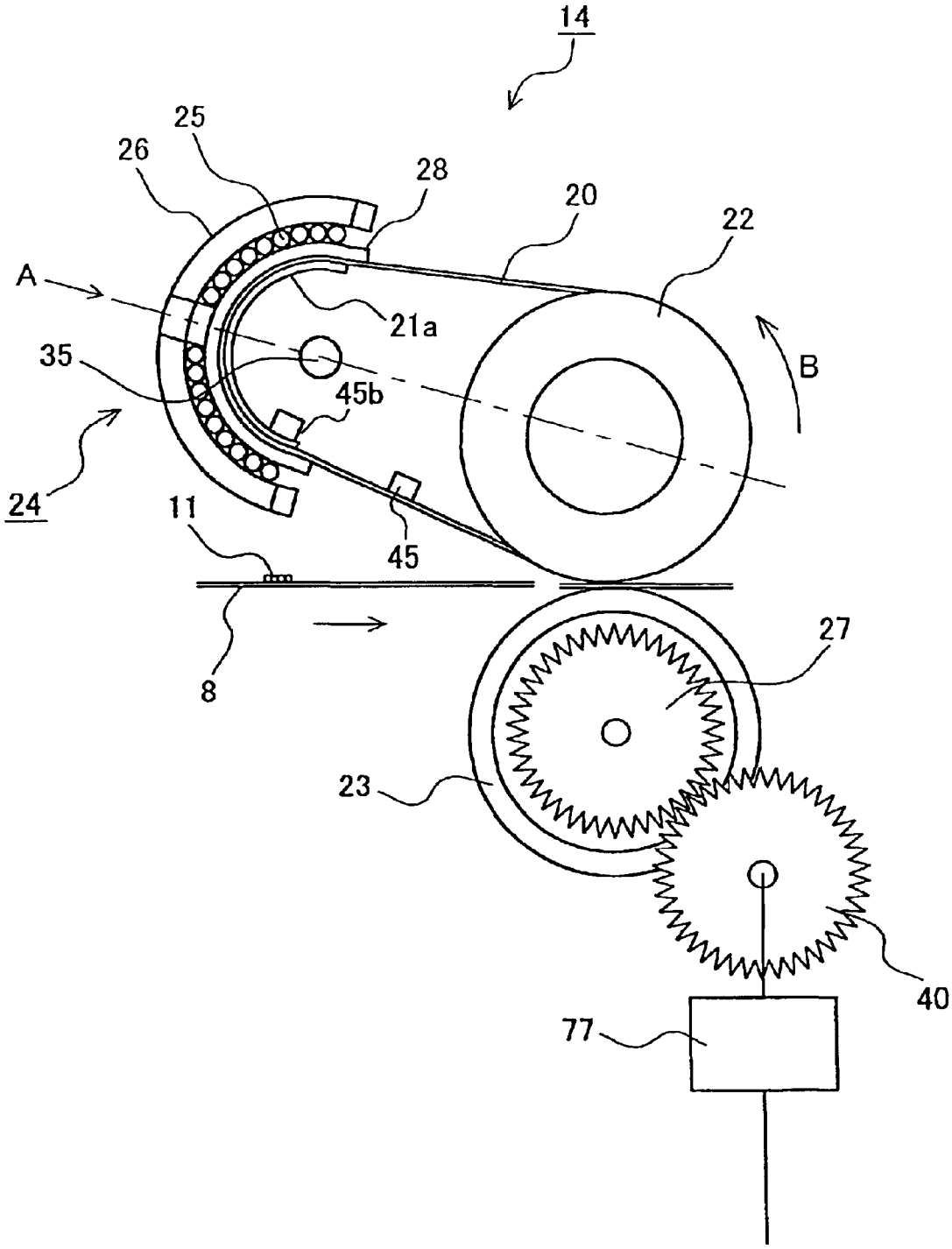
FIG. 7 is a cross-sectional view showing a fixing device serving as an image heating device in Example 4 of the present invention.
Figure 8:
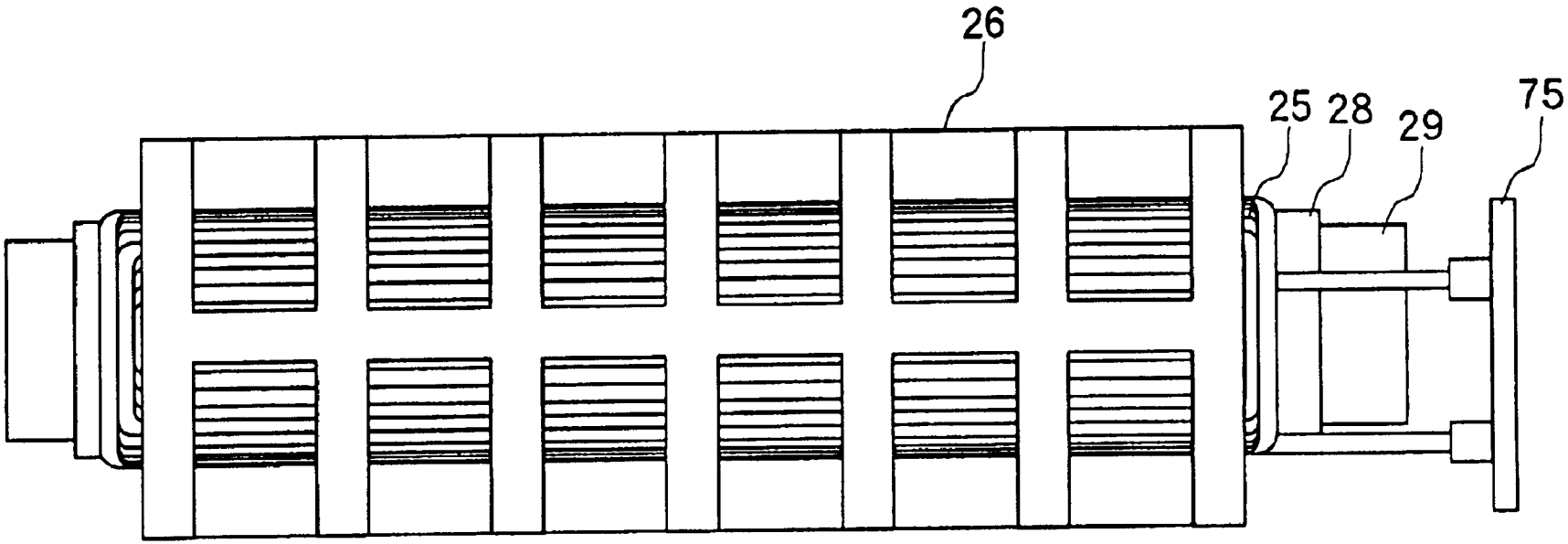
FIG. 8 is a plan view showing the fixing device in FIG. 7 as viewed in arrow direction A.
Figure 9:
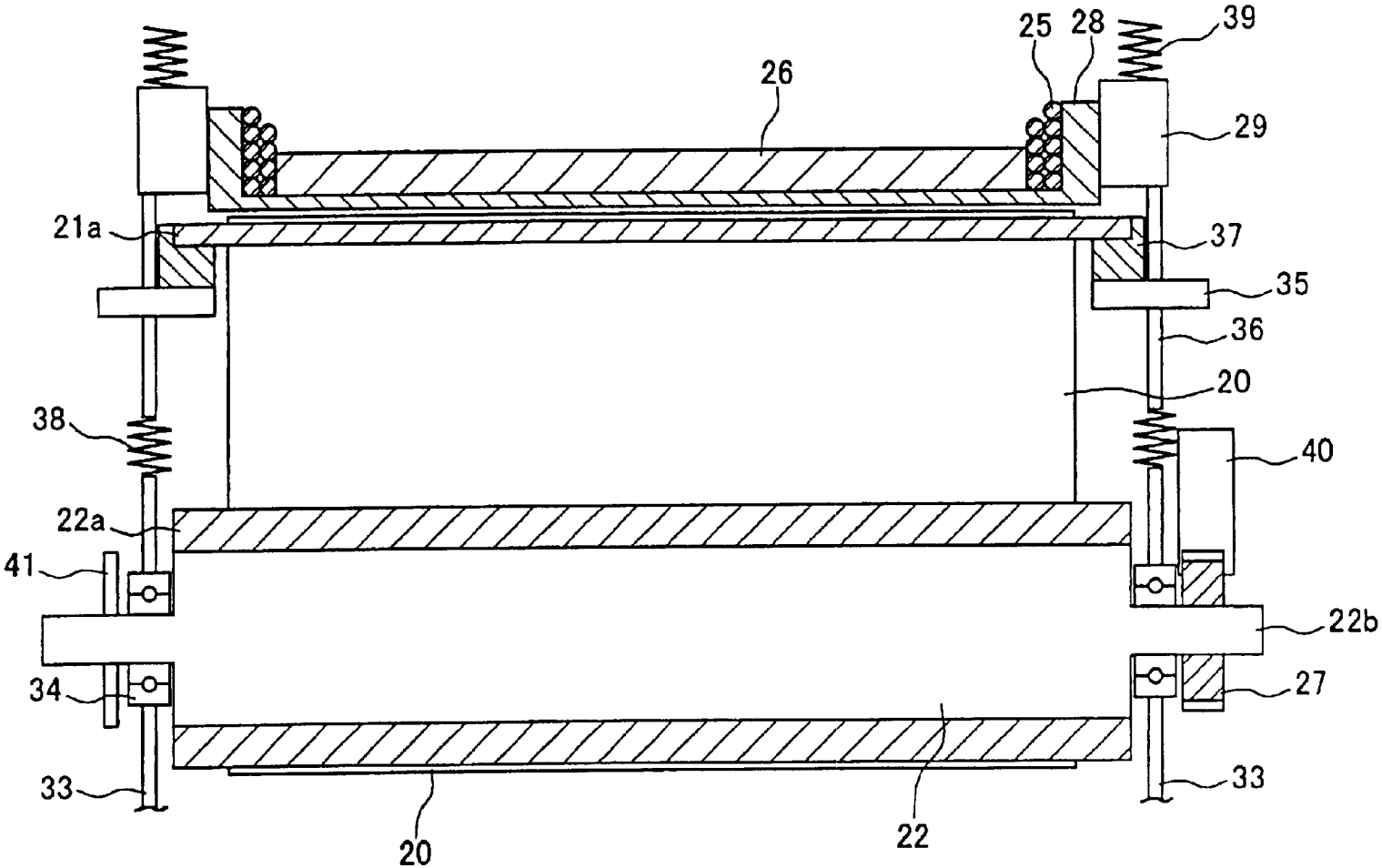
FIG. 9 is a cross-sectional view showing the fixing device in FIG. 7 taken along the center line.

FIG. 7 is a cross-sectional view showing a fixing device serving as an image heating device in Example 4 of the present invention, FIG. 8 is a plan view showing the fixing device in FIG. 7 as viewed in the arrow direction A, FIG. 9 is a cross-sectional view showing the fixing device in FIG. 7 taken along the center line.

In FIGS. 7 to 9, reference numeral 21*a* denotes a fixed semicylindrical heat generating member and reference numeral 25 denotes a magnetization coil. The magnetization coil 25 is formed of bundled wires comprising 40 copper wires of 0.15 mm diameter with insulated surfaces. The bundled wire extends in the longitudinal direction of a heat-generating member 21*a* (i.e., perpendicular to the face of FIG. 7) while winding around the heat-generating roller 21*a* in its circumferential direction.

The cross section of the magnetization coil 25 perpendicular to the longitudinal direction of the heat-generating member 21*a* is formed so as to cover a fixing belt 20 looped around the heat-generating member 21*a*, as shown in FIG. 7. As shown in FIG. 9, the bundled wires forming the magnetization coil 25 overlap with each other only in both end portions (in the longitudinal direction of the heat-generating member 21*a*) of the magnetization coil 25 and winding around the heat-generating member 21*a* along its circumferential direction for nine times while being in close contact with each other.

Reference numeral 26 denotes a core made of a material with high magnetic permeability. Magnetic flux generated by the magnetization coil 25 enters into the heat-generating member 21*a* from the convex portion in the middle of the core 26, and then travels inside the heat-generating member 21*a* in its circumferential direction, thereby forming a loop returning to both the ends of the core 26 and repeats generation and annihilation. Due to an inducing current induced by such changes in a state of the magnetic flux, Joule heat is generated in the heat-generating member 21*a*.

As shown in FIG. 8, a high-frequency current of 20 kHz to 50 kHz is applied to the magnetization coil 25 from an exciting circuit 75, which is an antiresonant inverter. The maximum amplitude of the high-frequency current is about 50 A.

Reference numeral 28 denotes a coil guide as a supporting member. The coil guide 28 is made of a resin with a superior heat resistance, such as PEEK material or PPS, and is formed in one piece with the magnetization coil 25 and the core 26. The coil guide 28 is fixed to a mounting member 29 by fixing the both ends thereof to the mounting member 29.

Hereinafter, a fixing unit according to the present example will be specifically described with reference to FIGS. 7 and 9.

In FIGS. 7 and 9, the fixing belt 20 is an endless of 50 mm diameter and 100 $\mu$m thickness, which comprises a polyimide resin as a base. The surface of the fixing belt 20 is coated with a lubricant layer (not shown in the drawing) made of a fluorocarbon resin of 20 $\mu$m thickness for enhancing lubrication. For the base, a very thin metal such as nickel fabricated by electroforming can be used in addition to a heat-resistant resin such as a polyimide resin or fluorocarbon resin. For the lubricant layer, a resin or rubber with good lubrication, such as PTFE, PFA, FEP, silicone rubber, or fluorocarbon rubber can be used alone or in combination.

The heat-generating member 21*a* is formed in a semicylindrical shape, which is 20 mm in diameter, 240 mm in length, and 0.4 mm in thickness. The heat-generating member 21*a* is formed of a magnetic material, specifically a carbon steel containing 0.05 to 0.5% of carbon and its Curie point has been adjusted to be not less than 400° C. The thermal capacity of the heat-generating member 21*a* is about 20 J/K.

Reference numeral 22 denotes a fixing roller of 30 mm outer diameter with low thermal conductivity, which comprises a core metal 22*b* and a layer 22*a* of elastic foamed silicone rubber with low hardness (Asker-C 40 degrees) formed on the core metal 22*b*. The fixing belt 20 is suspended with a predetermined tensile force between the fixing roller 22 and the heat-generating member 21*a*, and is rotationally movable in arrow direction B. On both ends of the heat-generating member 21*a*, ribs (not shown in the drawing) are provided for preventing snaking of the fixing belt 20.

Reference numeral 23 denotes a pressure roller as a pressurizing means. The pressure roller 23 is made of silicone rubber with a hardness of JIS A35 degrees. The pressure roller 23 is pressed against the fixing roller 22 via the fixing belt 20, thereby forming a nip portion. For the pressure roller 23, a heat-resistant resin or rubber such as fluorocarbon rubber other than the silicone rubber or a fluorocarbon resin also may be used. In order to enhance abrasion resistance and lubrication of the pressure roller 23, it is preferable that the surface of the pressure roller 23 is coated with a resin or rubber such as PFA, PTFE, or FEP alone or in combination.

Reference numeral 45 denotes a temperature sensor provided so as to be in contact with the inner peripheral surface of the fixing belt 20. The temperature sensor 45 generates a temperature signal upon detecting a temperature of the fixing belt 20.

As shown in FIG. 9, each end of the core metal 22*b* forming the fixing roller 22 is rotatably supported by a fixing bearing 34, which is a bearing fixed to a fixing side plate 33. The fixing roller 22 is rotationally driven by a gear 27 fixed to one end of the core metal 22*b* and meshing with a main body gear 40, which is rotationally driven by a motor provided in the image forming apparatus main body. The pressure roller 23 rotates following the fixing belt 20, which is rotated by the rotation of the fixing roller 22.

Reference numeral 35 denotes a central axis for supporting the heat-generating member 21*a*. The central axis 35 is fixed to a movable side plate 36 which is movable toward the fixing side plate 33. Reference numeral 37 denotes a flange made of a non-magnetic heat-resistant resin with low thermal conductivity, such as PPS or PEEK material. Reference numeral 38 denotes a tension spring. The tension spring 38 biases the movable side plate 36 in the direction away from the fixing plate 33, thereby applying a tensile force of 20 N to the fixing belt 20 suspended between the fixing roller 22 and the heat-generating member 21*a*.

Reference numeral 39 denotes a pressing spring. This pressing spring 39 biases the mounting member 29, to which the coil guide 28 is attached, toward the heat-generating member 21*a*. When the fixing unit 14 is attached to the image forming apparatus main body, the mounting member 29 is brought into contact with the movable side plate 36, thereby defining a distance and relative positions between the heat-generating member 21*a* in the fixing unit 14 and the magnetization coil 25 and coil guide 28 that are provided in the image forming apparatus main body.

Figure 10:
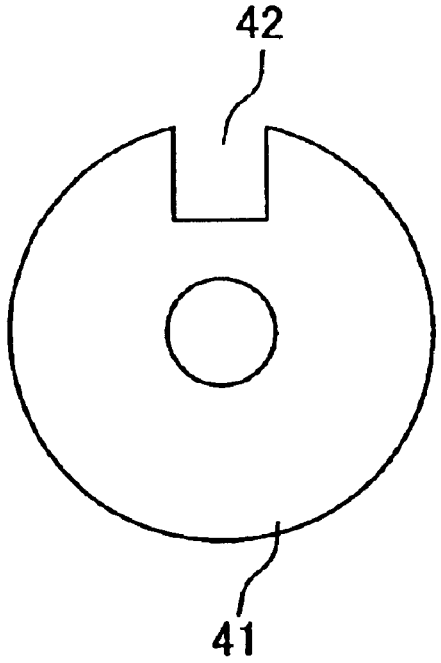
FIG. 10 is a side view showing a rotation detecting plate according to Example 4 of the present invention.
Figure 10:
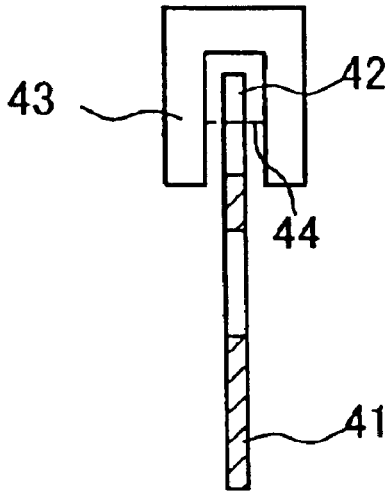

Reference numeral 41 denotes a rotation detecting plate. The rotation detecting plate 41 is fixed to the end, which is opposite to the end having the gear 27 fixed to the core metal 22*b*, of the fixing roller 22. The side view of the rotation detecting plate 41 is shown in FIG. 10. As shown in FIG. 10, a notch 42 is formed on the outer periphery of the rotation detecting plate 41, and the rotation detecting plate 41 is in a detecting portion of a photosensor 43-provided in the image forming apparatus main body in the state where the fixing unit 14 is attached to the image forming apparatus main body. If the fixing roller 22 rotates in this state, detecting light 44 emitted from the photosensor 43 is allowed to pass every time the notch 42 passes the detecting portion of the photosensor 43. Rotation of the fixing roller 22 thus can be detected. To prevent the rotation detecting plate 41 from interfering with the photosensor 43 when attaching/detaching the fixing unit 14, the direction in which the central surface of the opening of the photosensor 43 faces coincides with the direction in which the fixing unit 14 is attached/detached to/from the image forming apparatus main body.

Hereinafter, a method of controlling a heating operation of the fixing device will be described.

Figure 11:
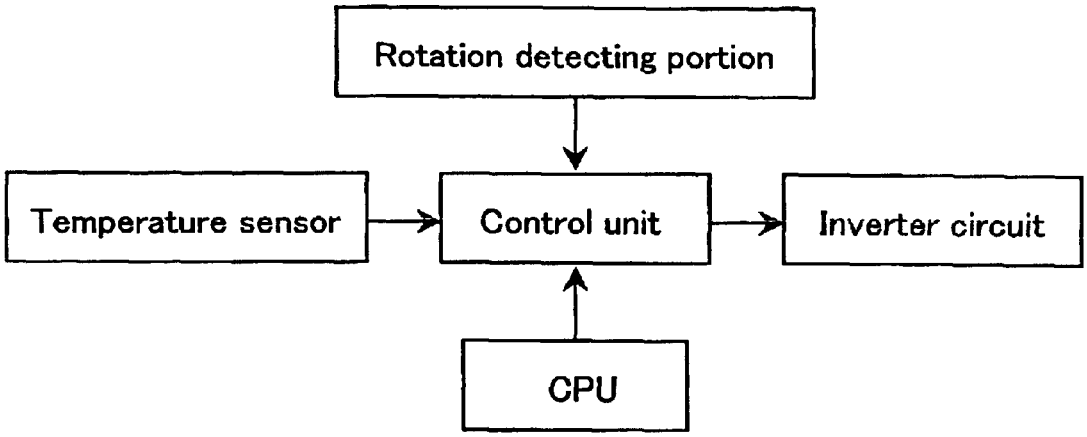
FIG. 11 is a block diagram illustrating control of an inverter circuit according to Example 4 of the present invention.
Figure 12:
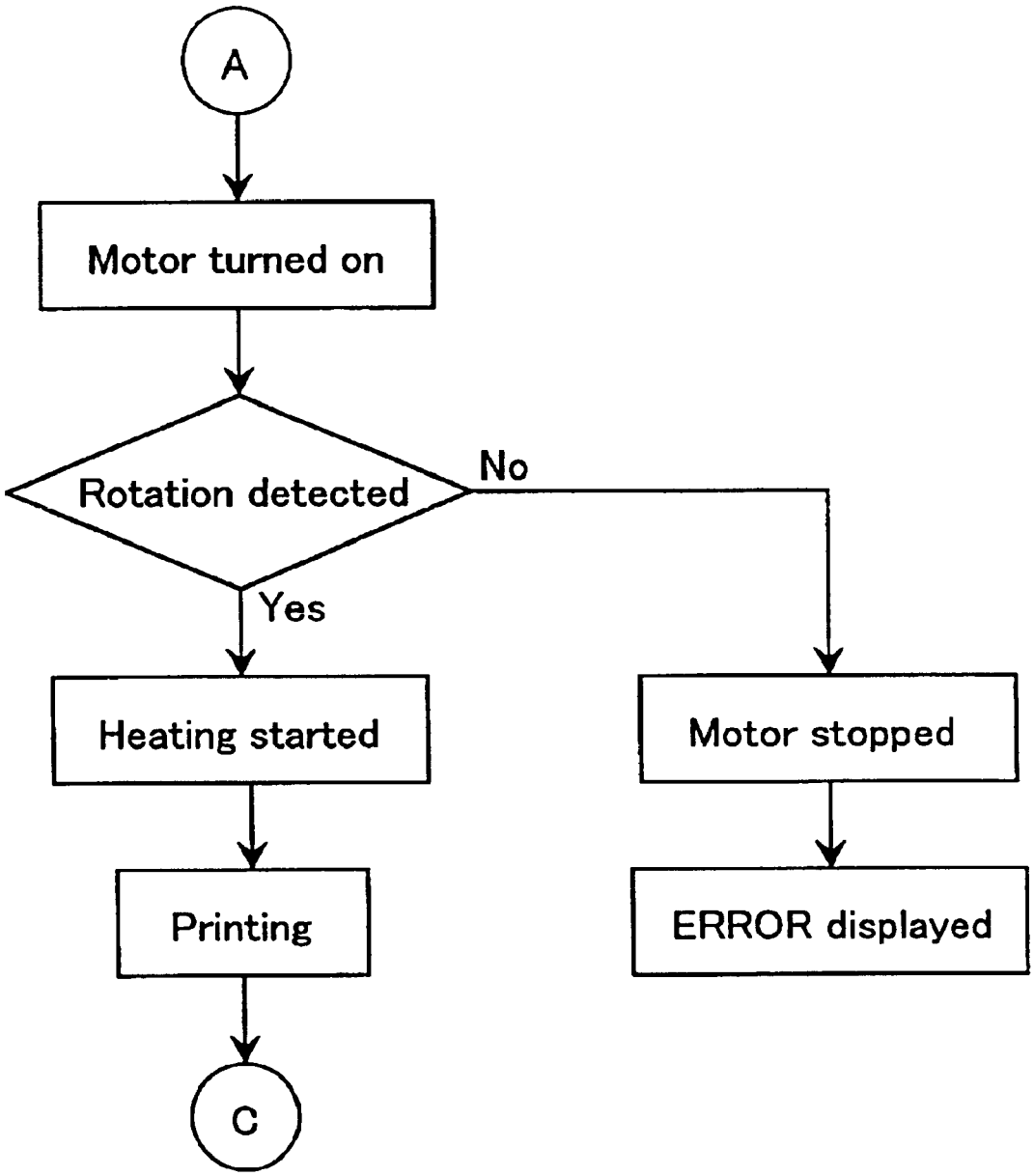
FIG. 12 is a flowchart illustrating a method of controlling a heating operation of the fixing device according to Example 4 of the present invention during start-up.
Figure 13:
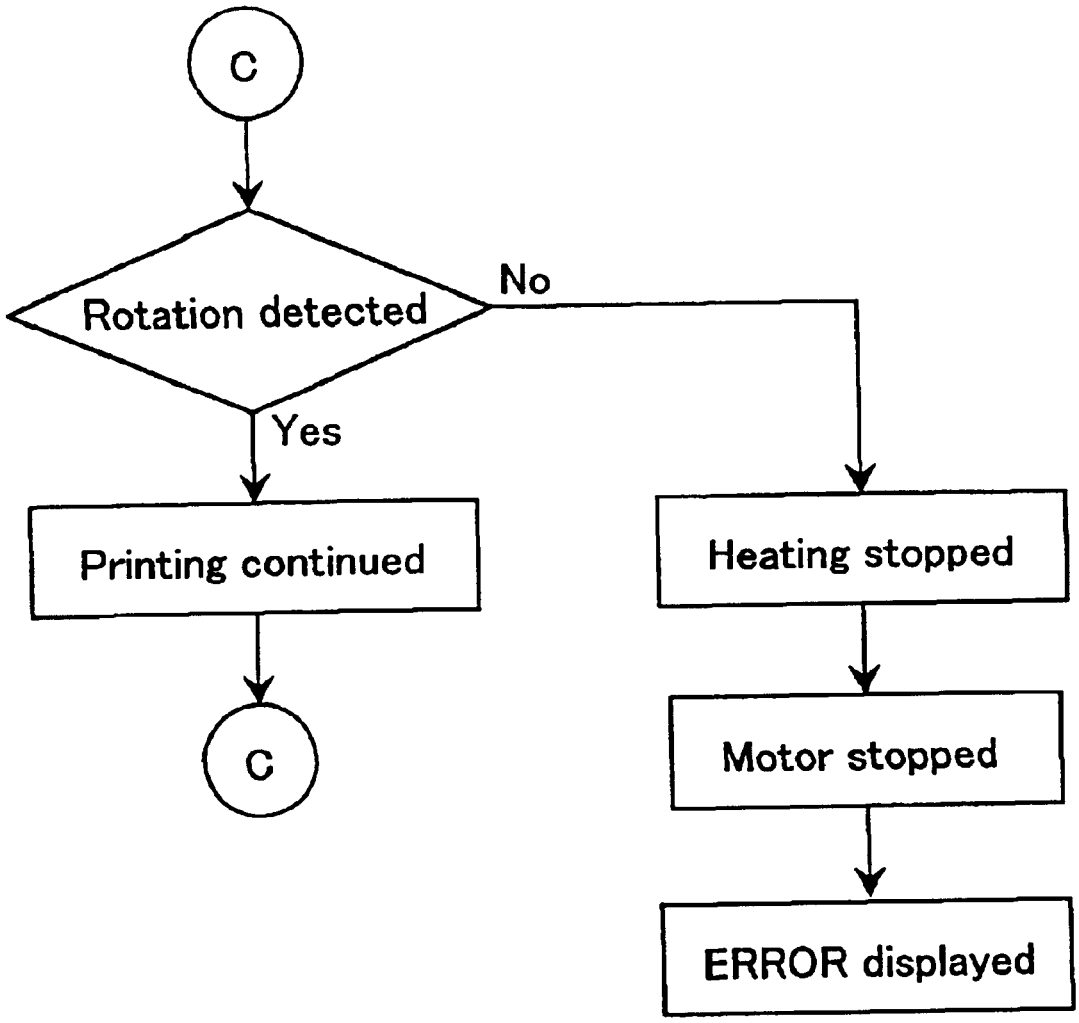
FIG. 13 is a flowchart illustrating a method of controlling a heating operation of the fixing device according to Example 4 of the present invention during printing operation.

FIG. 11 is a block diagram illustrating control of an inverter circuit in the present example, FIG. 12 is a flowchart illustrating a method of controlling a heating operation of the fixing device during start-up, and FIG. 13 is a flowchart illustrating a method of controlling a heating operation of the fixing device during printing operation.

In FIG. 11, a control unit receives a print start signal from a CPU, and then operates and controls the inverter circuit depending on signals from the temperature sensor and from the rotation detecting portion. In FIG. 12, the control unit receives a print start signal from the CPU (A), and then rotates a motor for rotationally driving the fixing unit 14 first. Subsequently, the rotation detecting plate 41 is rotated and the notch 42 passes the detecting portion of the photosensor 43 so that the rotation of the fixing roller 22 is detected. Upon receiving this detecting signal, the control unit transmits a heating start signal to the inverter circuit. The inverter circuit then applies a high-frequency current to the magnetization coil 25 so that heating is started, which is followed by a printing operation (C). The high-frequency current applied to the magnetization coil 25 is controlled by a temperature signal obtained from the temperature sensor 45 provided in the fixing belt 20 so that the fixing belt 20 is heated up to a predetermined fixing temperature, 170° C.

On the other hand, in the case where the rotation detecting signal cannot be obtained for a predetermined time period, for example, 1.2 seconds after the motor causing a rotation signal is turned ON, the control unit recognizes it as an abnormal condition and stops the motor and displays "ERROR" to alert the user.

Furthermore, in FIG. 13, in the case where the rotation detecting signals are being obtained from the photosensor 43 within a predetermined time interval, e.g., for one second, which is a little longer than the time interval required for the notch 42 of the rotation detecting plate 41 to pass the detecting portion of the photosensor 43 during printing operation (C), the control unit allows the printing operation to be continued. On the other hand, in the case where the rotation detecting signals are not obtained for a time interval longer than the above-mentioned predetermined time interval, the control unit recognize it as an abnormal condition and stops the motor and displays "ERROR" to alert the user.

The user then can check for insufficient attachment of the fixing unit 14 and damage to the components, and can stably use the image forming apparatus by bringing them to normal states. Additionally, the users can also deal with an abnormal condition caused by the changes in accordance with the passage of time during printing.

Since the life of the fixing belt 20 is not as long as the printing life of the image forming apparatus main body, it becomes necessary to replace the fixing unit 14 with a new unit. Also, in the case where the surface of the fixing belt 20 is damaged when eliminating paper jam or the like, the fixing belt 20 needs to be replaced with a new unit. According to the configuration of the present example, since a magnetization means such as the magnetization coil 25 remains in the image forming apparatus main body, the fixing unit 14 as a replacement part can be formed simply at a low cost.

When the fixing unit 14 is configured to be freely attachable/detachable to/from the image forming apparatus main body, insufficient attachment of the fixing unit 14 by the user may cause the following problems. That is, the gear 27 fixed to the core metal 22*b* of the fixing roller 22 may not be brought into sufficient mesh with the main body gear 40 even when the heat-generating member 21*a* and the magnetization means are in close proximity, and the gear 27 as a driving force transmitting means may be damaged during attachment of the fixing unit 14. The image forming apparatus according to the present example in which rotation of the rotation detecting plate 41 fixed to the fixing roller 22 is detected can detect the abnormal conditions as above and then stops the heating operation as well as displays "ERROR" to prompt for sufficient attachment of the fixing unit 14.

In the above-mentioned configuration, when the heat-generating member 21*a* was heated by the magnetization coil 25 while the fixing roller 22 was at rest (i.e., the fixing belt 20 was at rest), the heat-generating member 21*a* was heated up to 300° C. in a few seconds, thereby deforming the polyimide resin base of the fixing belt 20.

In the present example, the temperature sensor 45 is not provided on the surface opposing the magnetization means 24 of the heat-generating member 21*a*. This is because the heat-generating member 21*a* and the magnetization means 24 are spaced apart if the temperature sensor 45 is provided on the surface opposing the magnetization means 24, resulting in a degraded electromagnetic coupling between the heat-generating member 21*a* and the magnetization means 24. Furthermore, in the case where the magnetization means 24 is formed in a shape avoiding the temperature sensor 45, the amount of the heat generated from the heat-generating member 21*a* decreases only in the portion where the temperature sensor 45 is provided, resulting in uneven temperature distribution. It is to be noted that the temperature sensor 45 may be provided in a positions 45*a* or 45*b* shown in FIG. 2 or 45*b* shown in FIG. 7.

In electromagnetic induction heating, heat is generated most in the surface opposing the magnetization means 24, especially the exterior surface thereof, of the heat-generating members 21*a*. Accordingly, the temperature sensor 45 provided at either of the above-mentioned positions cannot measure the maximum temperature of the heat-generating portion when the fixing unit 14 is at rest. Therefore, it is particularly important to detect the rotation of the components of the fixing unit 14 during a heating operation and temperature control.

In the present example, in order to shorten the warm-up time, the thermal capacity of the fixing belt 20 is set as small as possible, and the thickness and outer diameter of the heat-generating member 21*a* are also set small to make its thermal capacity small. Therefore, the fixing belt 20 could be heated up to a predetermined temperature in about 15 seconds after the heating for preparing for the fixing is started with an electric power of 800 W being applied to the heat-generating member 21*a*.

Although the rotation detecting plate 41 depicted in FIG. 10 has only one notch 42, a plurality of notches may be provided in the rotation detecting plate 41, which enables shortening of the predetermined time period elapsed from the start of rotation of the fixing roller 22 until the rotation of the roller is detected. As a result, the time elapsed from when the control unit receives the print start signal from CPU until when the heating is started can be shortened. Besides, the time required for detecting a stop of the rotation during printing operation can be shortened at the same time. The heating thus can be stopped immediately after the rotation of the fixing unit 14 is stopped. As a result, an abnormal temperature rise in the components of the fixing unit 14 can be more reliably prevented from occurring.

Providing a marker or notch portion in the fixing belt 20 for detecting the rotation also can be considered as one option. However, providing the marker or notch portion in the fixing belt 20 leads to the following problems. That is, if the marker is provided on the outer peripheral surface of the fixing belt 20, the marker wears away due to the friction with the pressure roller 23. If the marker is provided on the inner peripheral surface of the fixing belt 20, the marker wears away due to the friction with the heat-generating member 21*a* and the fixing roller 22. On the other hand, if the notch portion is provided in the fixing belt 20, the fixing belt 20 may be cracked from the notch portion, thereby degrading durability of the belt.

Figure 14:
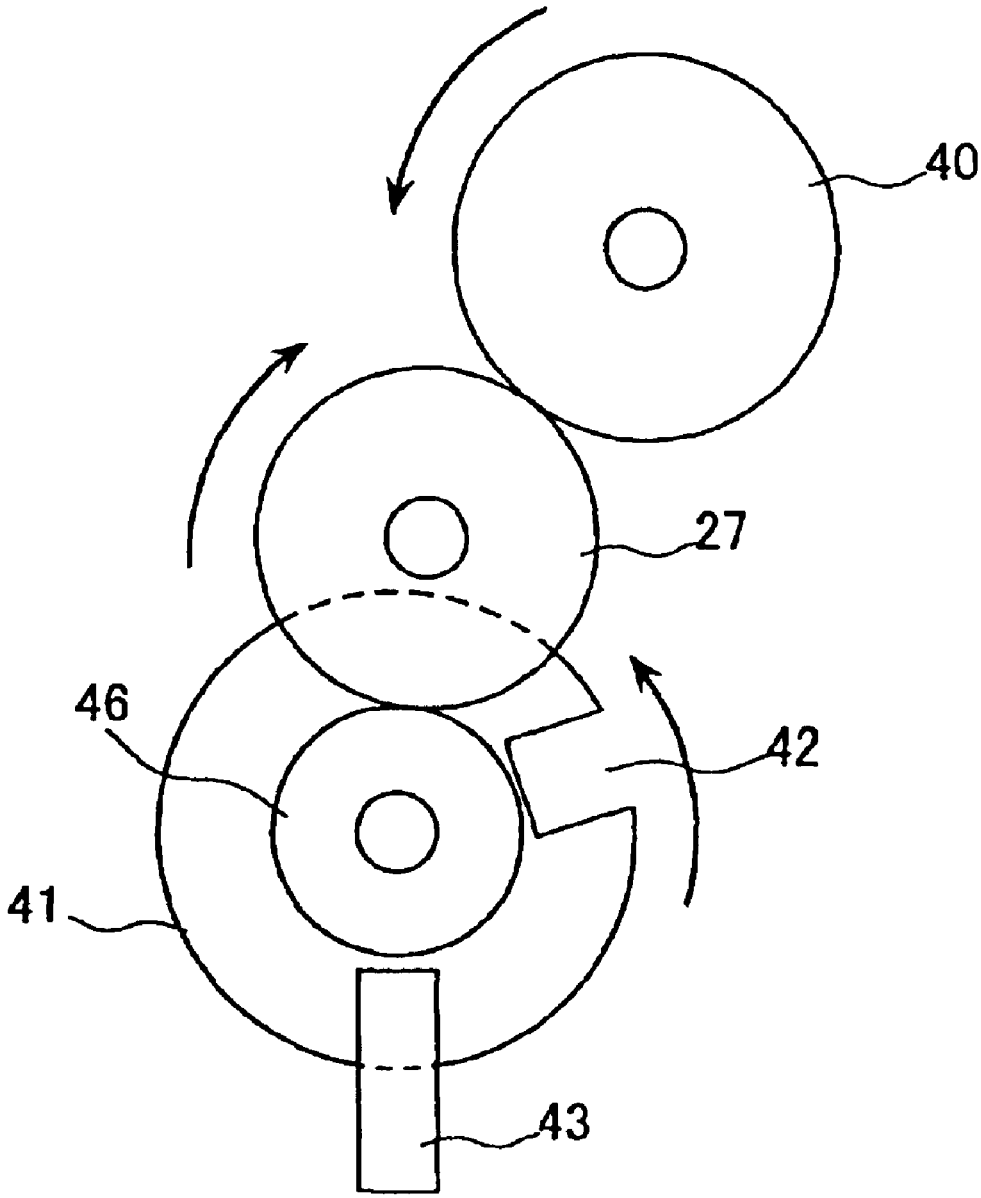
FIG. 14 is a side view showing a rotation detecting means according to Example 4 of the present invention.

The rotation detecting means may be configured as shown in FIG. 14. In FIG. 14, reference numeral 40 denotes a main body gear provided in the image forming apparatus main body, reference numeral 27 denotes a gear fixed to the fixing roller 22 and meshing with the main body gear 40, reference numeral 46 denotes an idler gear provided in the fixing unit 14 and meshing with the gear 27, reference numeral 41 denotes a rotation detecting plate, which rotates integrally with the idler gear 46, and reference numeral 43 denotes a photosensor. When the main body gear 40 rotates, the gear 27 and the idler gear 46 rotate following the main body gear 40. The rotation of the rotation detecting plate 41 is then detected by the photosensor 43.

According to this configuration, the transmission of a driving force to the gear 27 of the fixing unit 14 can be confirmed and the degree of freedom in placing the rotation detecting means in the image forming apparatus main body increases.

Furthermore, by providing another gear in the end of the fixing roller 22, which is opposite to the end having the gear 27, so as to mesh with the idler gear, which rotates integrally with the rotation detecting plate, the rotation of the fixing roller 22 can be reliably detected.

In the present example, the gear 27 is fixed to the fixing roller 22 to rotationally drive the fixing roller 22. However, as shown in FIG. 7, the gear 27 may be fixed to the pressure roller 23 so that the pressure roller 23 is rotationally driven by this gear 27 meshing with the main body gear 40, which is rotationally driven by the stepping motor 77 provided in the image forming apparatus main body. Alternatively, gears may be provided in a plurality of rollers, namely the fixing roller 22 and the pressure roller 23, to drive them, respectively.

EXAMPLE 5

Figure 15:
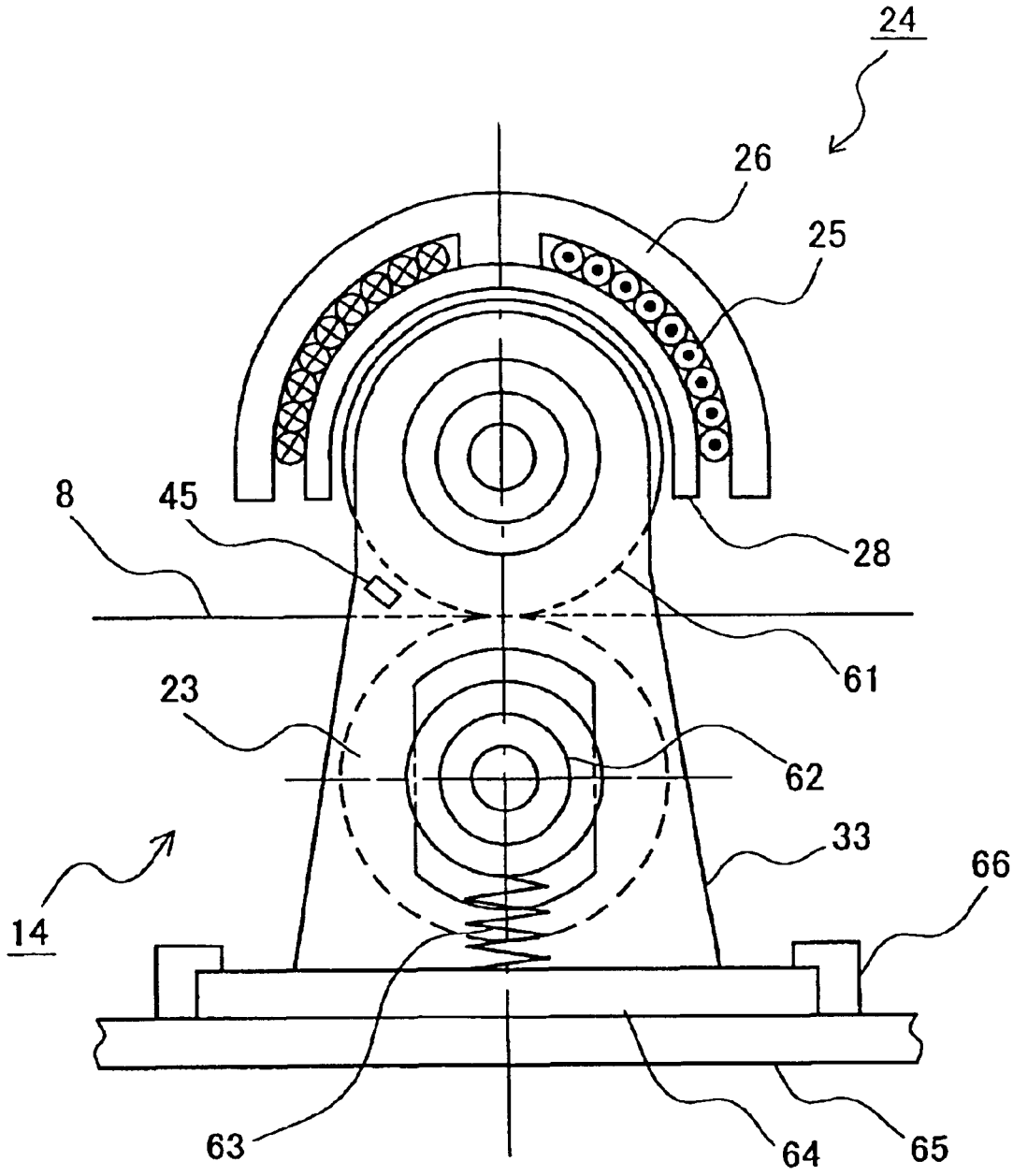
FIG. 15 is a side view showing a fixing device serving as an image heating device in Example 5 of the present invention.
Figure 16:
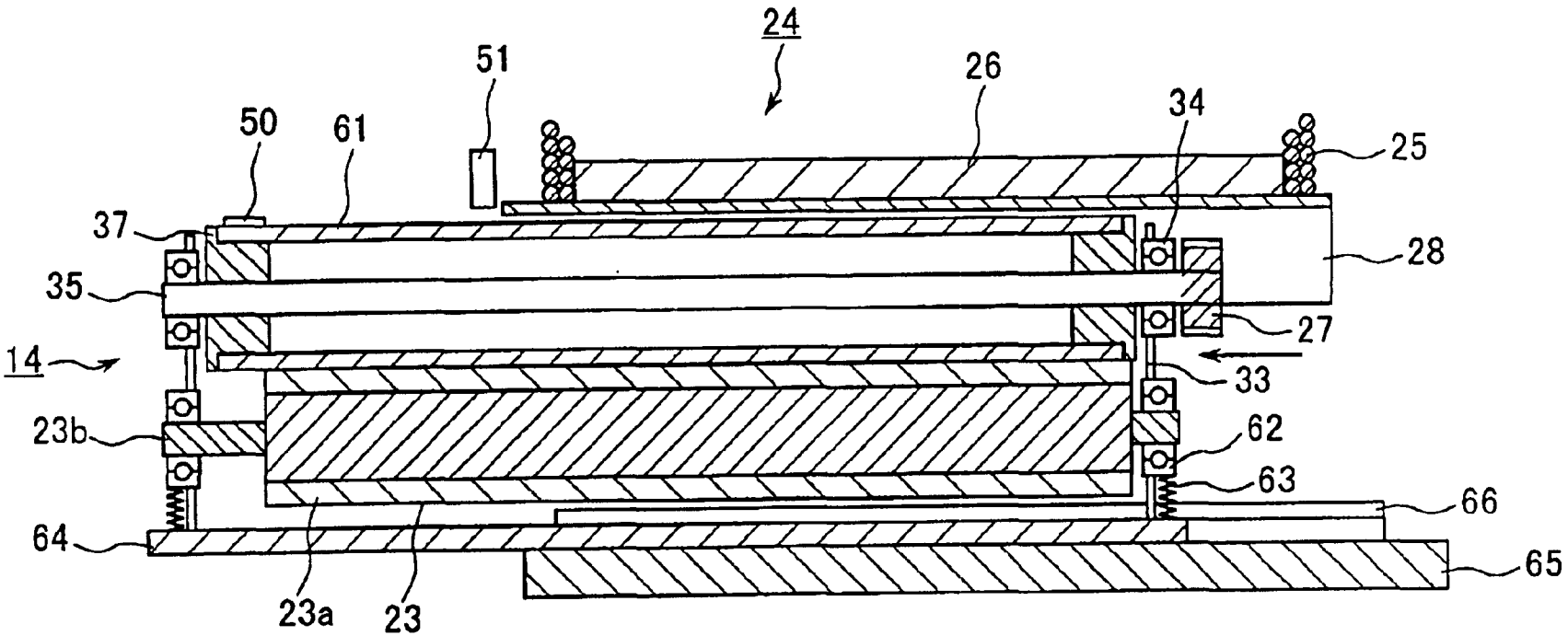
FIG. 16 is a cross-sectional view showing the fixing device in FIG. 15 taken along the center line.

FIG. 15 is a side view showing a fixing device serving as an image heating apparatus in Example 5 of the present invention, and FIG. 16 is a cross-sectional view showing the fixing device in FIG. 15 taken along the center line shown in FIG. 15.

In this example, elements having the same structure and performing the same function as in the fixing device of Example 4 are referred to with the same numerals and their further explanation has been omitted.

Unlike the above-mentioned example 4, the present example employs a heat-generating fixing roller 61 whose surface is coated with the same lubricant layer as that in a fixing belt 20. The heat-generating fixing roller 61 is pressed against a pressure roller 23 directly, thereby forming a nip portion.

Figure 18:
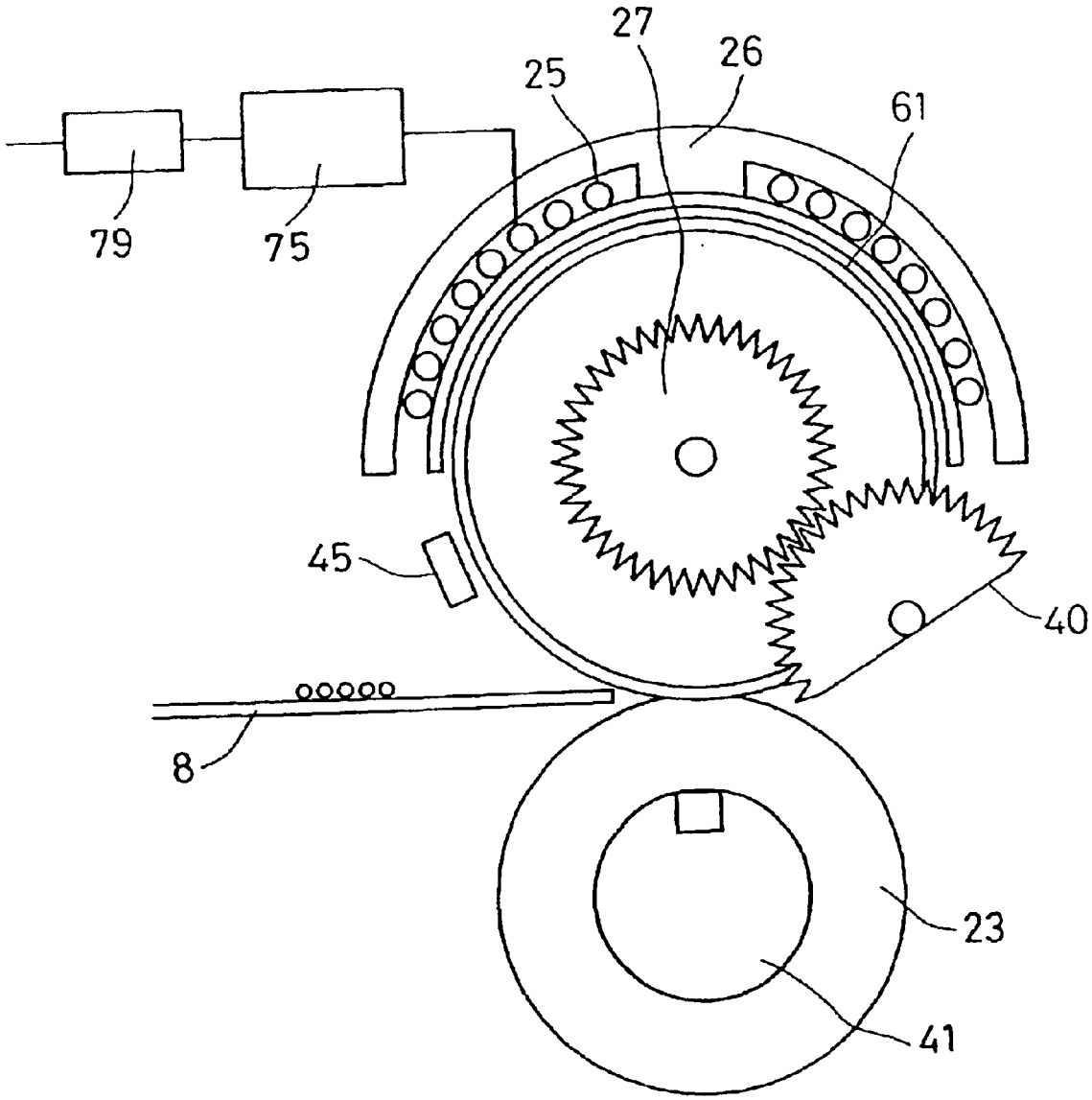
FIG. 18 is a cross-sectional view showing a rotation driving mechanism according to Example 5 of the present invention.

As shown in FIG. 18, the heat-generating fixing roller 61 is rotationally driven by a gear 27 fixed to an end thereof and meshing with a main body gear 40, which is rotationally driven by a stepping motor 77 provided in the image forming apparatus main body. The pressure roller 23 rotates following the heat-generating fixing roller 61.

The pressure roller 23 comprises a bearing 62, which is movably supported by a long hole on a fixing side plate 33 and biased toward the heat-generating fixing roller 61 by a pressing spring 63. The heat-generating fixing roller 61 is longer than the pressure roller 23 and a rotation detecting marker 50 with a reflectance different from that of the surface of the heat-generating fixing roller 61 is provided in a portion of the peripheral surface of the heat-generating fixing roller 61 that is not in contact with the pressure roller 23. A temperature sensor 45 is provided in the vicinity of the entrance to a nip portion formed between the heat-generating fixing roller 61 and the pressure roller 23. The detected output from this temperature sensor 45 controls output from an exiting circuit 75 via a control means 79. A high-frequency current is applied to the magnetization coil 25 from the exiting circuit 75.

The fixing side plates 33 provided at both ends of the pressure roller 23 and heat-generating fixing roller 61 are fixed to a fixing bottom plate 64. The fixing unit 14 is formed in one piece with the fixing bottom plate 64, the fixing side plates 33, the pressure roller 23, and the heat-generating fixing roller 61. A bottom plate 65 of the image forming apparatus main body is provided with a fixing guide 66 for guiding the fixing bottom plate 64 in the axial direction of the heat-generating fixing roller 61. A magnetization means 24 is fixed to the image forming apparatus main body.

Figure 17:
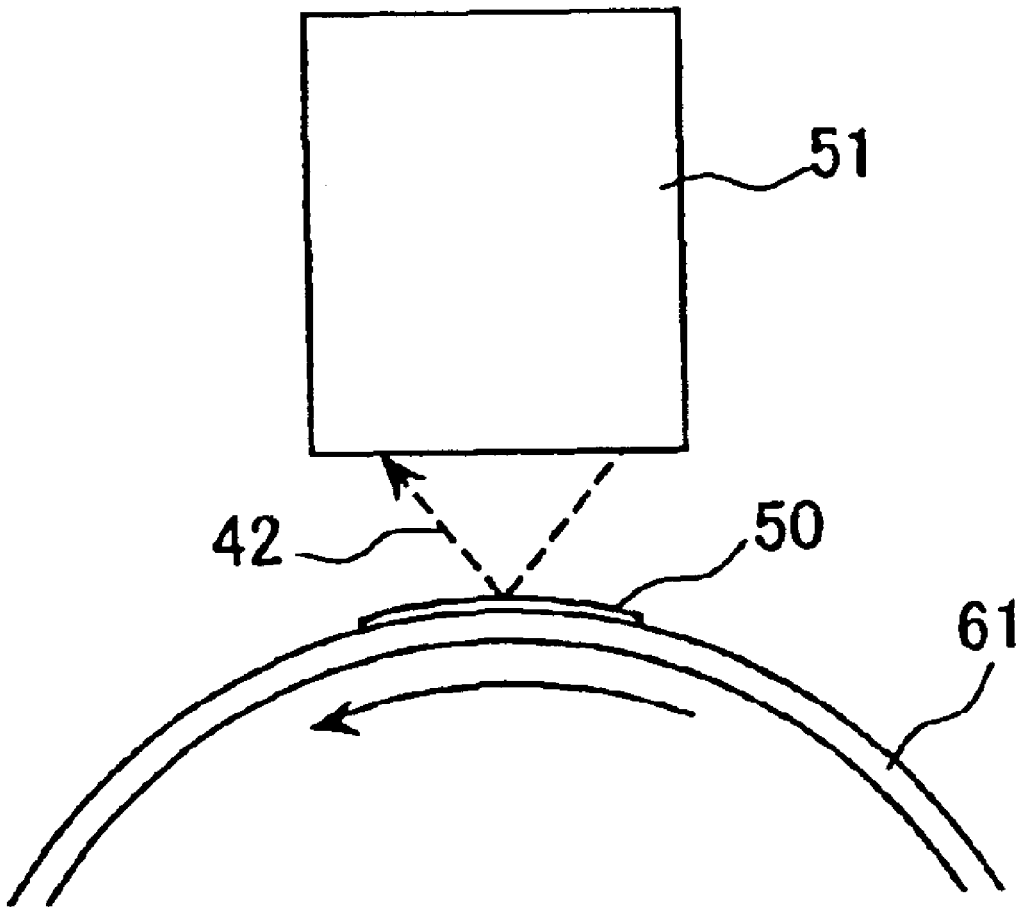
FIG. 17 is a side view showing a rotation detecting means according to Example 5 of the present invention.

A rotation detecting marker 50 opposes a reflection type photosensor 51 when the fixing unit 14 is attached to the image forming apparatus main body. As shown in FIG. 17, when the heat-generating fixing roller 61 rotates, the rotation detecting marker 50 reflects a signal light 42 emitted from the photosensor 51 so that rotation of the heat-generating fixing roller 61 is detected by the photosensor 51.

As described above, since the fixing unit 14 is configured so that the reflection type photosensor 51 is used as a rotation detecting sensor and the rotation detecting marker 50 is provided on the peripheral surface of the heat-generating fixing roller 61, the components of the fixing unit 14 never interfere with the photosensor 51 during attachment/detachment of the fixing unit 14 in the axial direction of the heat-generating fixing roller 61. The attachment/detachment of the fixing unit 14 to/from the image forming apparatus main body thus can be performed easily. Further, according to this configuration, the fixing unit 14 can be replaced with a new unit by moving the fixing unit 14 in the axial direction while leaving the magnetization means 24 fixed on the image forming apparatus main body.

Although the rotation detecting marker 50 is provided on the peripheral surface of the heat-generating fixing roller 61 in the present example, the rotation detecting marker 50 may be provided on the peripheral surface of the pressure roller 23 or in the members that rotate with the heat-generating fixing roller 61, such as a bearing at the end portion of the core metal of the pressure roller 23. In this case, not only the rotation of the heat-generating fixing roller 61 receiving a driving force from the image forming apparatus main body but also rotation of the members that receive a driving force for rotation from the heat-generating fixing roller 61 can be detected.

Figure 19:
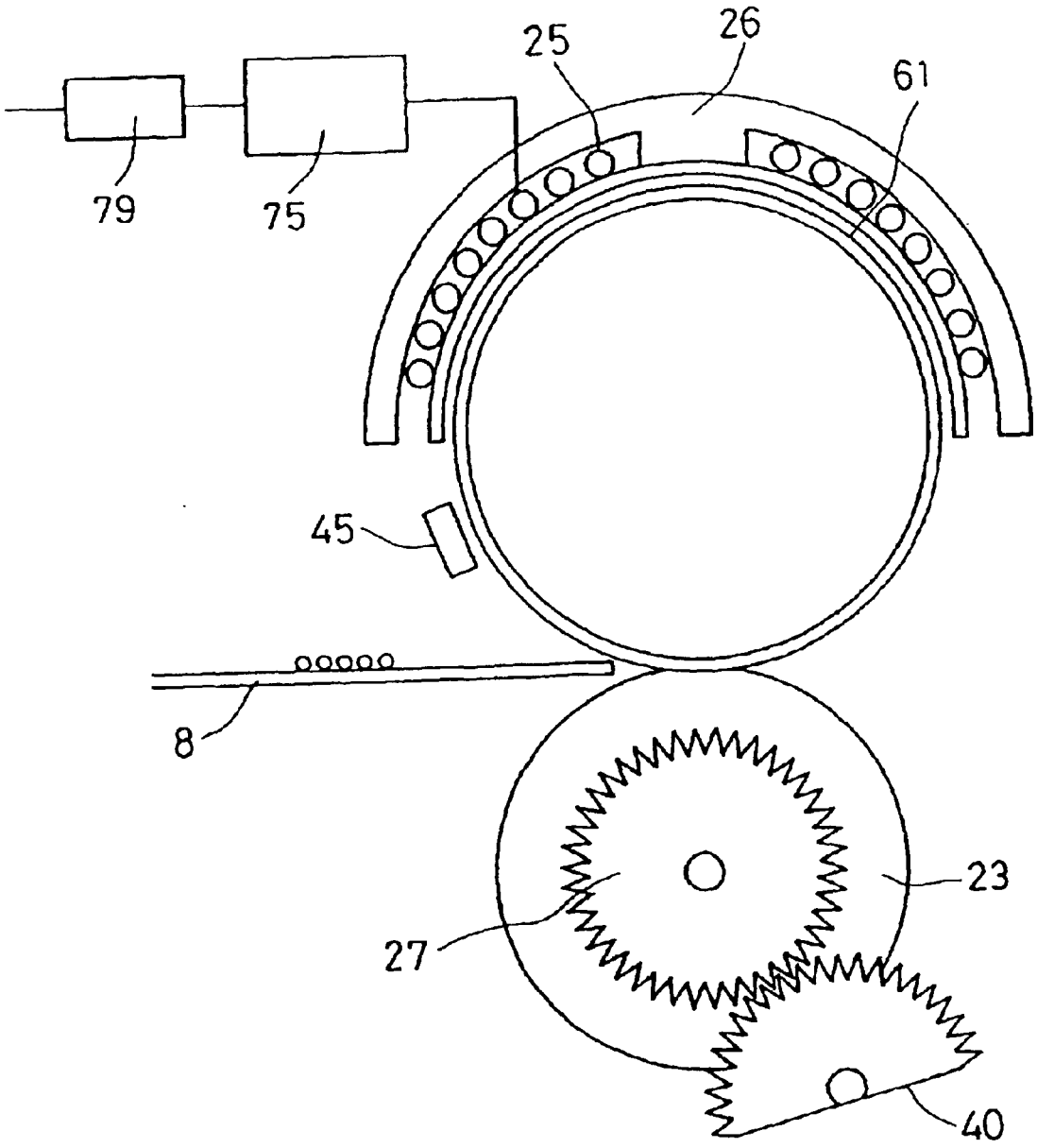
FIG. 19 is a cross-sectional view showing another aspect of the rotation driving mechanism according to Example 5 of the present invention.

In the present example, the gear 27 is fixed in heat-generating fixing roller 61 to rotationally drive the heat-generating fixing roller 61. However, as shown in FIG. 19, the gear 27 may be fixed to the pressure roller 23 so that the pressure roller 23 is rotationally driven by this gear 27 meshing with the main body gear 40, which is rotationally driven by the stepping motor 77 provided in the image forming apparatus main body. Alternatively, gears may be provided in a plurality of rollers, namely heat-generating fixing roller 61 and the pressure roller 23, to drive them, respectively.

The fixing device serving as an image heating device described in each above-mentioned example can be used for both fixing monochrome images and for fixing color images.

[Second Embodiment]

Figure 20:
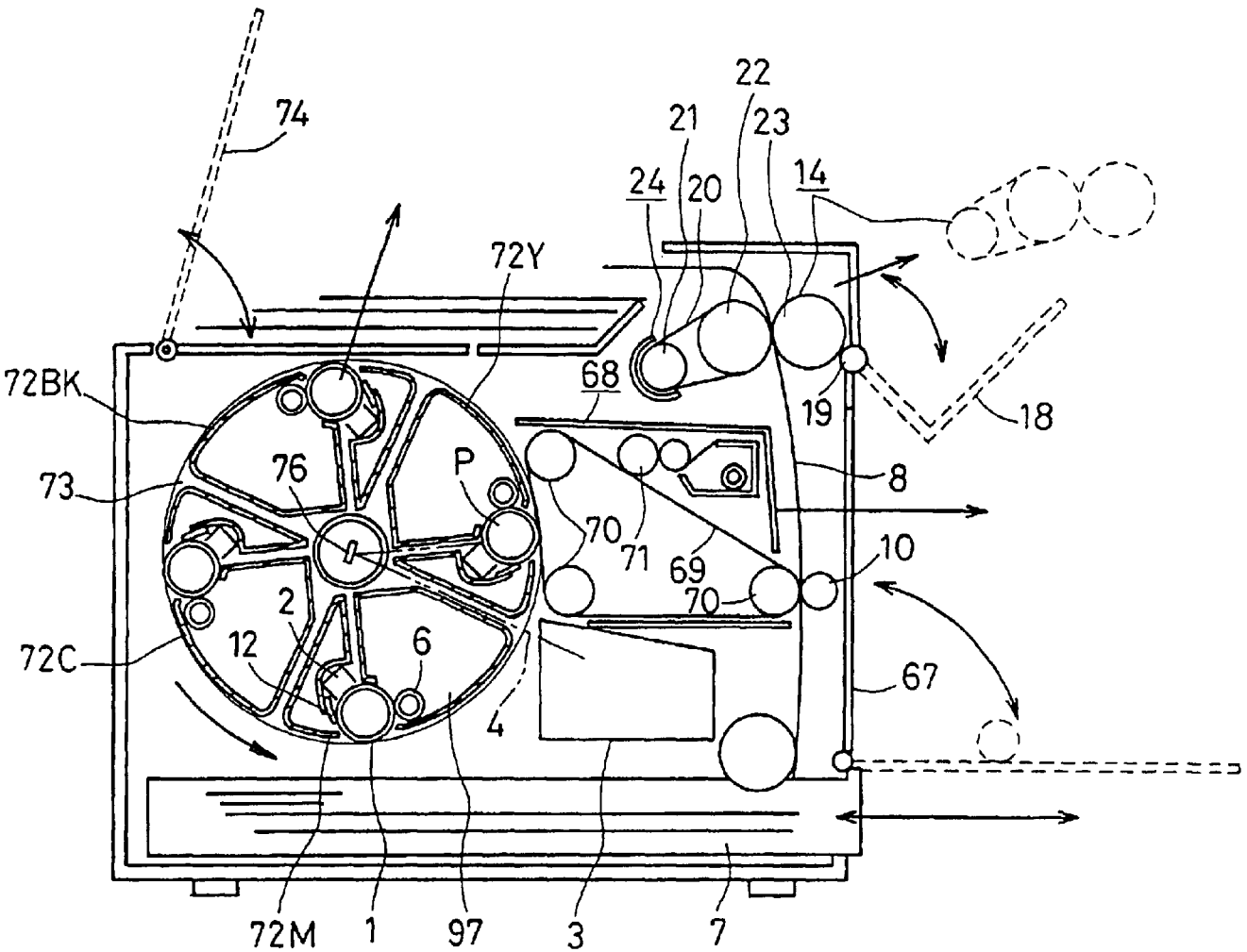
FIG. 20 is a cross-sectional view showing a color image forming apparatus according to a second embodiment of the present invention.

FIG. 20 is a cross-sectional view showing a color image forming apparatus according to the second embodiment of the present invention.

In FIG. 20, the right-hand face is the front face of the color image forming apparatus, on which a front door 67 is provided. Reference numeral 68 denotes a transfer belt unit including an intermediate transfer belt 69, three support axes 70 suspending the intermediate transfer belt 69, and a cleaner 71, which are formed in one piece, and attached to the color image forming apparatus in a freely attachable and detachable manner. In this case, as shown in FIG. 20, the transfer belt unit 68 can be attached/detached to/from the color image forming apparatus after opening the front door 67.

On the left side of the interior of the color image forming apparatus, a carriage 73 is provided adjacent to the transfer belt unit 68. The carriage 73 contains four annularly arranged image forming units 72BK, 72C, 72M, and 72Y for four colors, i.e., black (BK), cyan (C), magenta (M), and yellow (Y), respectively, each having a cross section of substantially fan shape. The carriage 73 is rotatable in the arrow direction.

The image forming unit 72, which is formed in one piece with a photosensitive drum 1 and process elements arranged around the drum, includes the following components.

Reference numeral 2 denotes a corona charger for charging the photosensitive drum 1 with a homogeneous negative charge, reference numeral 97 denotes developing devices containing black toner, cyan toner, magenta toner, and yellow toner, respectively, for forming toner images of respective colors by supplying negatively charged toner from developing rollers 6 to an electrostatic latent image formed on the opposing photosensitive drum 1. In FIG. 20, reference numeral 3 denotes a laser beam scanner provided beneath the transfer belt unit 68.

The image forming units 72BK to 72Y can be attached/detached to/from the color image forming apparatus by opening a top door 74 on a top face of the color image forming apparatus. When the carriage 73 rotates, the image forming units 72BK, 72C,72M, and 72Y rotate around a fixed mirror 76. The image forming units 72BK, 72C, 72M, and 72Y are shifted sequentially to the image forming position P opposing the intermediate transfer belt 69.

Next, an operation of the color image forming apparatus configured as above will be described in the following.

First, the carriage 73 is rotated to shift the image forming unit 72Y for the first color yellow to the image forming position P (a state illustrated in FIG. 20). In this state, a laser beam 4 emitted from the laser beam scanner 3 passes through the portion between the image forming units 72Y and the image forming units 72M for magenta and is then refracted from the mirror 76 to enter the photosensitive drum 1 that is at the image forming position P, thereby forming an electrostatic latent image on the photosensitive drum 1. This electrostatic latent image is developed by yellow toner conveyed to the developing roller 6 of the developing device 97 that opposes the photosensitive drum 1. Subsequently, the yellow toner image formed on the photosensitive dram 1 is primarily transferred to the intermediate transfer belt 69.

After the formation of the yellow toner image is completed, the carriage 73 is rotated 90° in the arrow direction to shift the image forming unit 72M for magenta to the image forming position P. An image forming operation is performed, similarly as for yellow, thereby forming a magenta toner image so as to overlap the yellow toner image on the intermediate transfer belt 69. Similar image forming operations are repeated for cyan and black in this order, so that a toner image including the four toner images overlapped with each other are formed on the intermediate transfer belt 69.

The transfer roller 10 is brought into contact with the intermediate transfer belt 69 with suitable timing so that the top position of the black toner image formed by the fourth image forming operation comes to the position of the transfer roller 10. Subsequently, recording paper 8 is fed to the nip portion formed between the transfer roller 10 and the intermediate transfer belt 69, thereby transferring (which is a secondary transfer) the toner image of four colors onto the recording paper 8. The recording paper 8 onto which the toner image has been transferred passes through the fixing unit 14 to fix the toner image thereon and then is ejected to the outside of the color image forming apparatus. Toner remaining on the intermediate transfer belt 69 after the secondary transfer is removed by the cleaner 71, which separates from and contacts with the intermediate transfer belt 69 with suitable timing.

After formation of one toner image is completed, the image forming unit 72Y for yellow is shifted to the image forming position P, thus completing the preparation for subsequent image formation.

In the present embodiment, the fixing belt 20 comprises a polyimide resin of 90 μm thickness as a base, onto which silicone rubber of 150 μm thickness is laminated. The fixing belt 20 is tensioned in the direction in which the fixing unit 14 is attached/detached to/from the color image forming apparatus main body.

As shown in FIG. 20, in the fixing unit 14, the heat-generating roller 21, the fixing roller 22, and the pressure roller 23 can be attached/detached to/from the color image forming apparatus main body as one unit while leaving the magnetization means 24 in the image forming apparatus main body. The direction in which the fixing roller 20 is tensioned as well as the direction in which the opening of the magnetization means 24 with a semicircular cross section is opened coincide with the direction in which the fixing unit 14 is attached/detached to/from the color image forming apparatus main body. As a result, the magnetization means 24 and the heat-generating roller 21 do not interfere with each other, which allows easy attachment/detachment of the fixing unit 14. The attachment/detachment of the fixing unit 14 can be performed by opening/closing a fixing door 18.

In the present embodiment, the fixing roller 22 is rotationally driven by the color image forming apparatus main body, and rotation of the heat-generating roller 21, which rotates following the fixing roller 22 via the fixing belt 20, is detected. According to this configuration, a state where the heat-generating roller 21 accidentally stops due to rupturing of the fixing belt 20 or slipping between the fixing roller 22 and the fixing belt 20 also can be detected. Accordingly, the color image forming apparatus according to the present embodiment can display "ERROR" upon more strictly detecting abnormal conditions.

Figure 21:
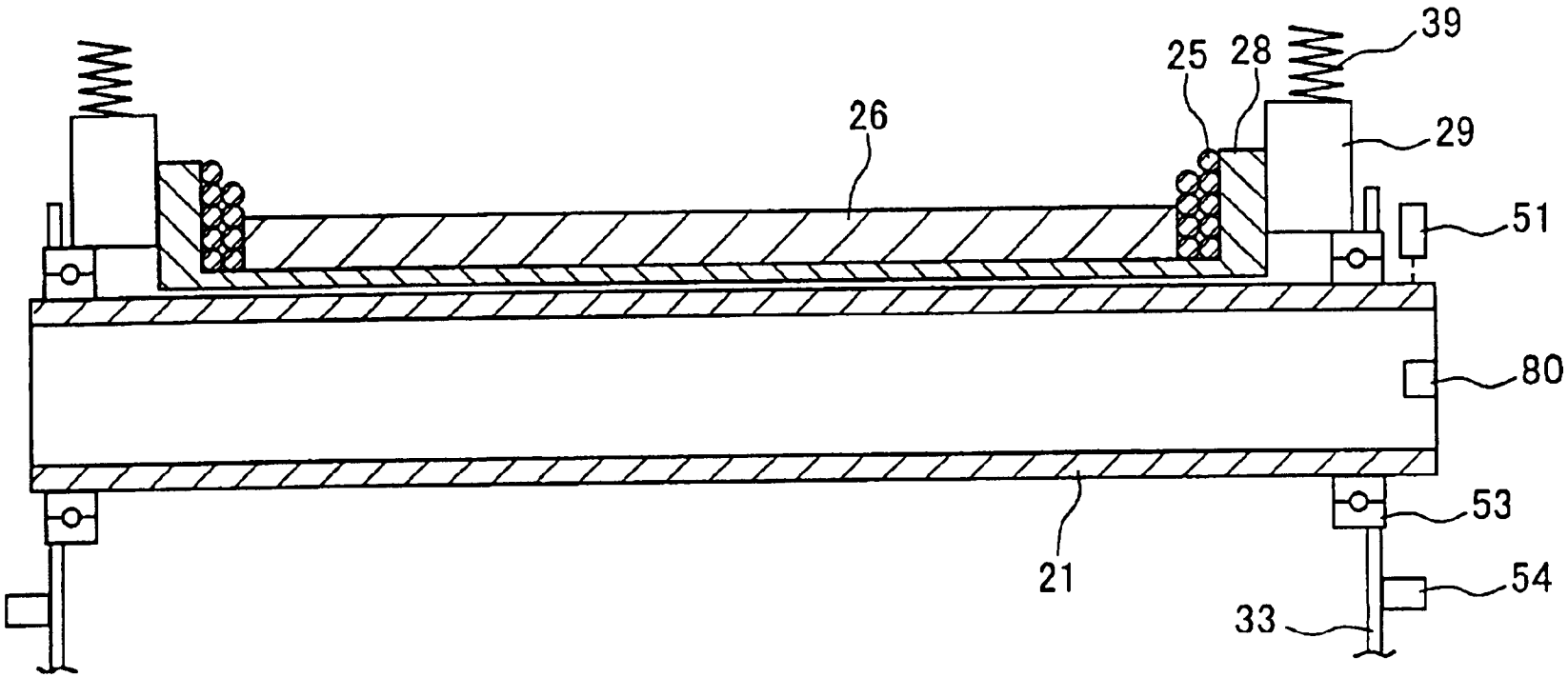
FIG. 21 is a cross-sectional view showing a rotation detecting means according to the second embodiment of the present invention.

As shown in FIG. 21, a reflection type photosensor 51 is used as a rotation detecting sensor and a rotation detecting marker (not shown in the drawing) is provided on the peripheral surface of the heat-generating roller 21. According to this configuration, components of the fixing unit 14 do not interfere with the photosensor 51 even when the fixing unit 14 is attached/detached to/from the color image forming apparatus main body in the direction perpendicular to the rotation axis of the heat-generating fixing roller 21. The attachment/detachment of the fixing unit 14 thus can be performed easily.

Furthermore, because the magnetization means 24 remains in the color image forming apparatus main body, the fixing unit 14 can be formed simply at a low cost. Moreover, in addition to elimination of paper jam and replacements of a paper supplying portion 7, a transfer belt unit 68, and a image forming unit 72 in the entire color image forming apparatus, replacement of the fixing unit 14 also can be performed easily from the front side of the color image forming apparatus.

Figure 22:
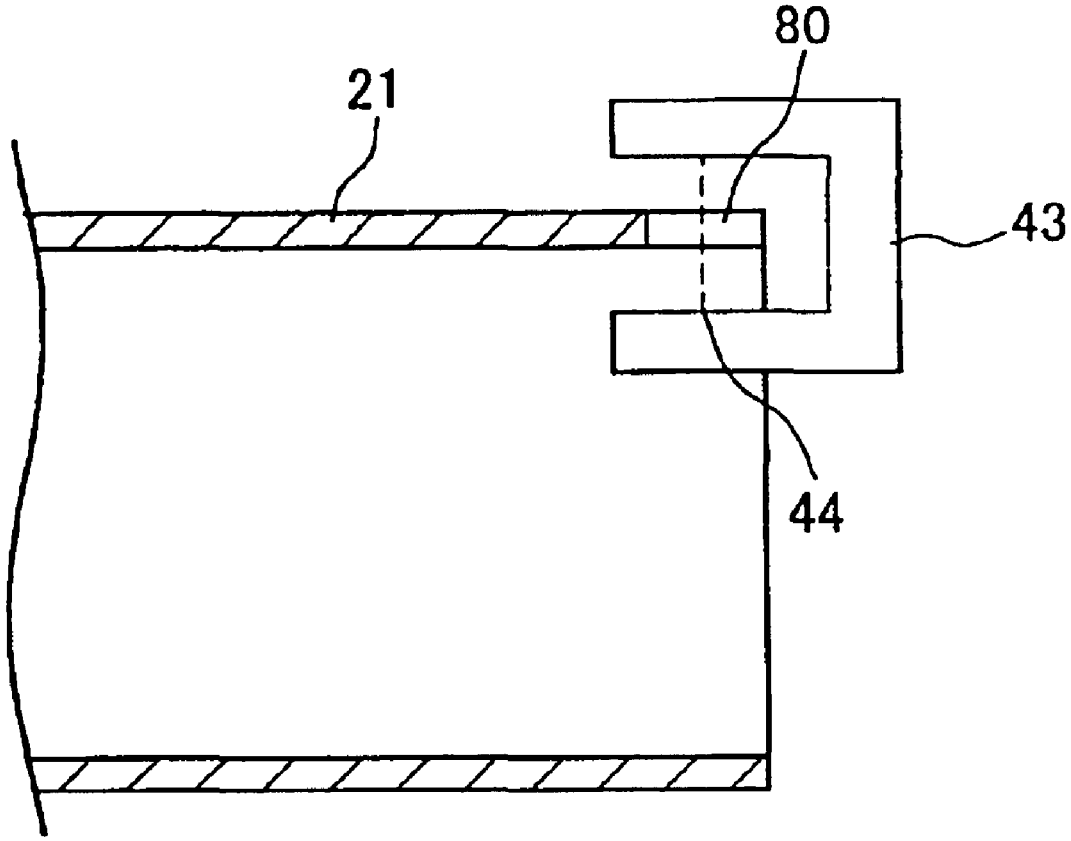
FIG. 22 is a cross-sectional view showing another aspect of the rotation detecting means according to the second embodiment of the present invention.
Figure 23:
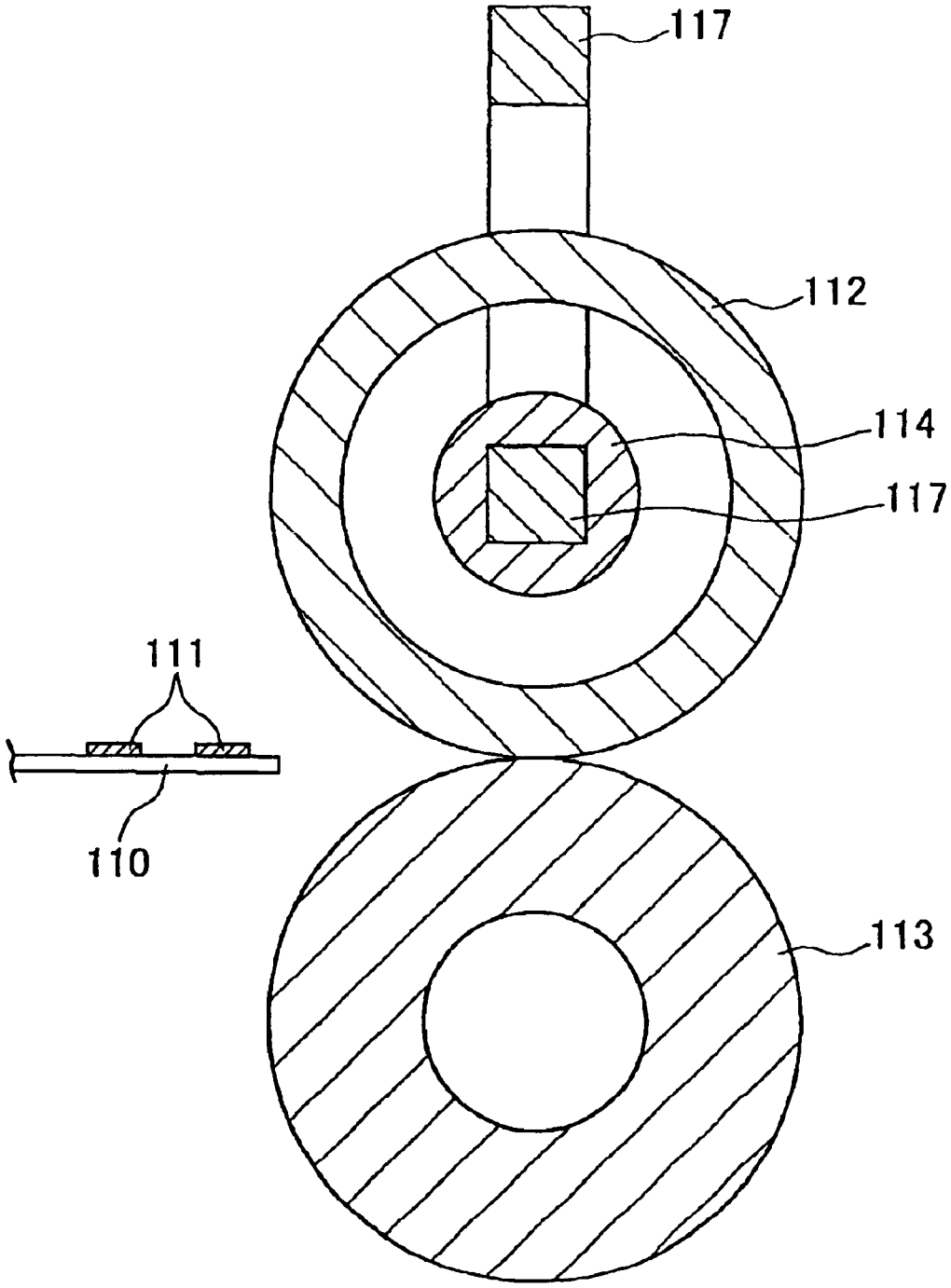
FIG. 23 is a cross-sectional view showing a conventional image heating device utilizing electromagnetic induction.
Figure 24:
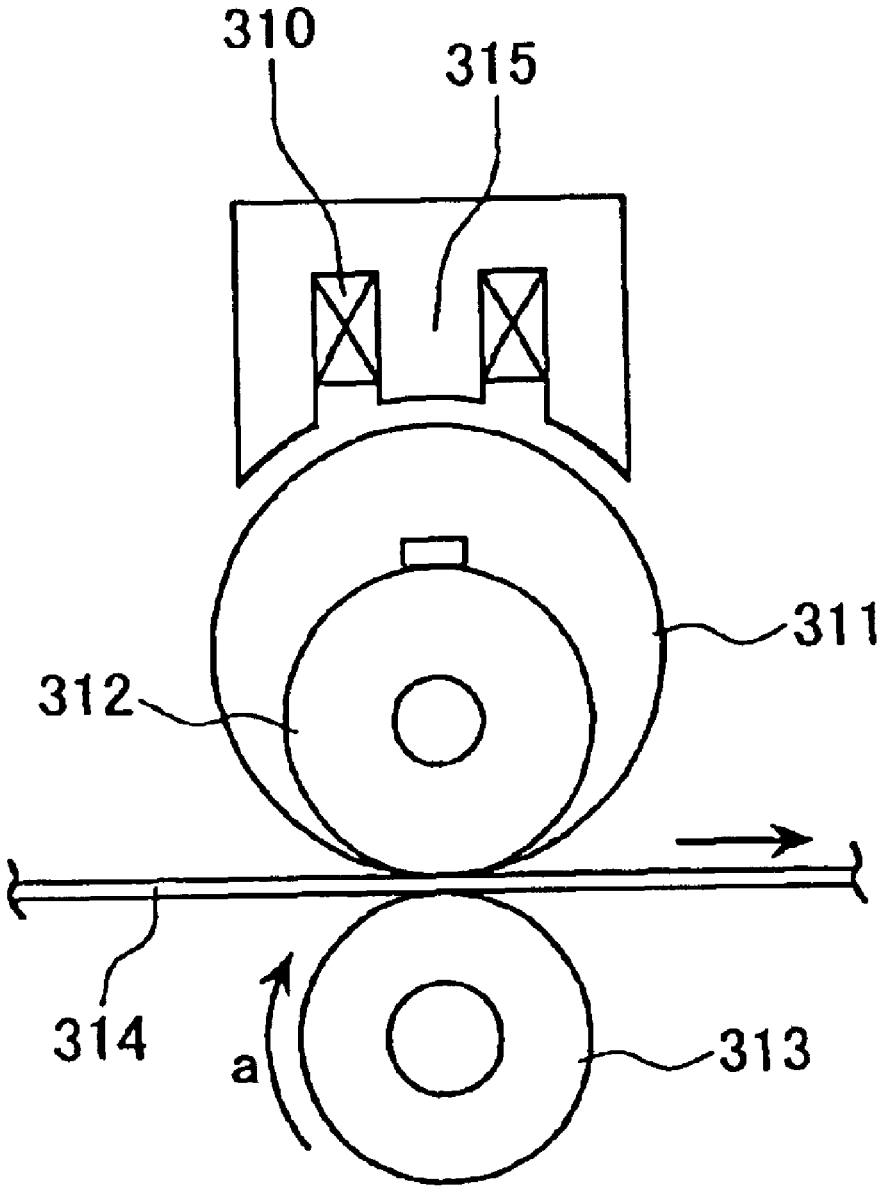
FIG. 24 is a cross-sectional view showing another aspect of the conventional image heating device utilizing electromagnetic induction.

As shown in FIGS. 21 and 22, rotation of the heat-generating roller 21 can be detected by detecting a notch 80 formed on an end thereof by the transmission type photosensor 43. In this case, since the fixing unit 14 is attached/detached to/from the color image forming apparatus in the direction perpendicular to the rotation axis of the heat generating roller 21, it is preferable that the photosensor 43 is included in the fixing unit 14 as one of its components and attached/detached to/from the color image forming apparatus integrally with the fixing unit 14. When the photosensor 43 is provided in the color image forming apparatus main body, detection of the rotation may not be performed accurately due to insufficient attachment of the fixing unit 14. However, by adopting the configuration in which the photosensor 43 is attached/detached to/from the color image forming apparatus integrally with the fixing unit 14, detection of the rotation can be performed accurately at all times.

Although the fixing roller 22 is rotationally driven by the color image forming apparatus main body in the present embodiment, a gear may be fixed to the pressure roller 23 so that the pressure roller 23 is rotationally driven by this gear meshing with a main body gear, which is rotationally driven by a stepping motor provided in the image forming apparatus main body. Alternatively, a gear may be fixed to the heat-generating roller 21 so that the heat-generating roller 21 is rotationally driven by this gear meshing with the main body gear, which is rotationally driven by the stepping motor provided in the image forming apparatus main body. Further, it is also possible to provide gears in a plurality of rollers, namely the heat-generating roller 21, the fixing roller 22, and the pressure roller 23, to drive them, respectively.

As the fixing belt 20 used in the present embodiment, a belt can be used that comprises a belt base fabricated by electroforming with nickel, which is 30 μm in thickness and 60 mm in diameter, onto which silicone rubber of 150 μm thickness has been formed for fixing color images.

Although the magnetization means is arranged in opposition to the outer peripheral surface of the heat-generating roller (heat-generating member) in each above-mentioned embodiment, it is to be noted that the same effect can be obtained when the magnetization means is provided inside the heat-generating roller (heat-generating member) if the temperature sensor is provided in the portion other than the portion heated most, i.e., the portion in which the magnetization means and the heat-generating roller (heat-generating member) oppose each other.

Furthermore, although the magnetization coil is used as the magnetization means in each above-mentioned embodiment, it is to be noted that the magnetization means is not limited to the magnetization coil and other magnetization members also can be used.

INDUSTRIAL APPLICABILITY

As specifically described above, the present invention can realize an image heating device with a small thermal capacity that can be heated rapidly. The image heating device according to the present invention thus can be suitably used as a fixing device for fixing unfixed images.

What is claimed is:

1. An image forming apparatus comprising:

a heat-generating member;

a pressure member pressed against the heat-generating member, a magnetization coil for heating the heat-generating member through electromagnetic induction;

an inverter circuit for supplying a high-frequency current to the magnetization coil;

a control unit for controlling an operation of the inverter circuit; and a temperature sensor for detecting a temperature of the heat-generating member, wherein both the temperature sensor and a nip portion formed between the heat-generating member and the pressure member are arranged at a portion other than a portion of the heat-generating member that is heated most by the magnetization coil.

2. The image forming apparatus according to claim 1, wherein the temperature sensor is positioned in the vicinity of the nip portion formed between the heat-generating member and the pressure member.

3. The image forming apparatus according to claim 1, wherein the temperature sensor is positioned at a portion in which the heat-generating member and the pressure member oppose each other and on a heat-generating member side with respect to a recording material fed to the nip portion formed between the heat-generating member and the pressure member.

4. The image forming apparatus according to claim 1, wherein the temperature sensor is provided at a portion on an upstream side from the nip portion formed between the heat-generating member and the pressure member in a direction in which a recording material is fed.

5. The image forming apparatus according to claim 1, wherein the magnetization coil is arranged in opposition to an outer peripheral surface of the heat-generating member.

6. An image forming apparatus comprising:

a heat-generating member;

a pressure member pressed against the heat-generating member;

a magnetization coil for heating the heat-generating member through electromagnetic induction;

an inverter circuit for supplying a high-frequency current to the magnetization coil;

a control unit for controlling an operation of the inverter circuit; and a temperature sensor for detecting a temperature of the heat-generating member, wherein a portion of the heat-generating member that is heated most by the magnetization coil, the temperature sensor, a nip portion formed between the heat-generating member and the pressure member are at positions different from one another.

7. The image forming apparatus according to claim 6, wherein the temperature sensor is positioned in the vicinity of the nip portion formed between the heat-generating member and the pressure member.

8. The image forming apparatus according to claim 6, wherein the temperature sensor is positioned at a portion in which the heat-generating member and the pressure member oppose each other and on a heat-generating member side with respect to a recording material fed to the nip portion formed between the heat-generating member and the pressure member.

9. The image forming apparatus according to claim 6, wherein the temperature sensor is provided at a portion on an upstream side from the nip portion formed between the heat-generating member and the pressure member in a direction in which a recording material is fed.

10. The image forming apparatus according to claim 6, wherein the magnetization coil is arranged in opposition to an outer peripheral surface of the heat-generating member.

11. An image forming apparatus comprising:

a rotatable heat-generating body;

a pressure member pressed against a portion of the heat-generating body;

a magnetization coil for heating the heat-generating body through electromagnetic induction;

an inverter circuit for supplying a high-frequency current to the magnetization coil;

a control unit for controlling an operation of the inverter circuit; and a temperature sensor for detecting a temperature of the heat-generating body, wherein a portion of the heat-generating body that is heated most by the magnetization coil is on an upstream side from a nip portion formed between the heat-generating body and the pressure member in a rotating direction of the heat-generating body, and the temperature sensor is arranged on a downstream side from the nip portion in the rotating direction of the heat-generating body.

12. The image forming apparatus according to claim 11, wherein the heat-generating body comprises a fixing belt, and the temperature sensor is arranged on a side of a rear surface of the fixing belt.

13. The image forming apparatus according to claim 11, wherein the heat-generating body comprises a heat-generating roller, a fixing roller pressed against the pressure member, and a fixing belt suspended between the heat-generating roller and the fixing roller.

14. The image forming apparatus according to claim 11, wherein the magnetization coil is arranged in opposition to an outer peripheral surface of the heat-generating body.

15. An image forming apparatus comprising:

a rotatable heat-generating body;

a pressure member pressed against a portion of the heat-generating body;

a magnetization coil for heating the heat-generating body through electromagnetic induction;

an inverter circuit for supplying a high-frequency current to the magnetization coil;

a control unit for controlling an operation of the inverter circuit; and a temperature sensor for detecting a temperature of the heat-generating body, wherein a portion of the heat-generating body that is heated most by the magnetization coil is on either an upstream side or a down stream side from a nip portion formed between the heat-generating body and the pressure member in a rotating direction of the heat-generating body, and the temperature sensor is positioned on a side different from the side on which the portion of the heat-generating body that is heated most is provided.

16. The image forming apparatus according to claim 15, wherein the heat-generating body comprises a fixing belt, and the temperature sensor is positioned on a side of a rear surface of the fixing belt.

17. The image forming apparatus according to claim 15, wherein the heat-generating body comprises a heat-generating roller, a fixing roller pressed against the pressure member, and a fixing belt suspended between the heat-generating roller and the fixing roller.

18. The image forming apparatus according to claim 15, wherein the magnetization coil is arranged in opposition to an outer peripheral surface of the heat-generating body.

19. An image forming apparatus comprising:

a rotatable heat-generating body;

a pressure member pressed against a portion of the heat-generating body;

a magnetization coil for heating the heat-generating body through electromagnetic induction;

an inverter circuit for supplying a high-frequency current to the magnetization coil;

a control unit for controlling an operation of the inverter circuit; and a temperature sensor for detecting a temperature of the heat-generating body, wherein a portion of the heat-generating body that is heated most by the magnetization coil and the temperature sensor are at different positions on an upstream side from a nip portion formed between the heat-generating body and the pressure member in a rotating direction of the heat-generating body.

20. The image forming apparatus according to claim 19, wherein the heat-generating body comprises a fixing belt, and the temperature sensor is arranged on a side of a rear surface of the fixing belt.

21. The image forming apparatus according to claim 19, wherein the heat-generating body comprises a heat-generating roller, a fixing roller pressed against the pressure member, and a fixing belt suspended between the heat-generating roller and the fixing roller.

22. The image forming apparatus according to claim 19, wherein the magnetization coil is arranged in opposition to an outer peripheral surface of the heat-generating body.

23. An image forming apparatus comprising:

a rotatable heat-generating body;

a pressure member pressed against a portion of the heat-generating body;

a magnetization coil for heating the heat-generating body through electromagnetic induction;

an inverter circuit for supplying a high-frequency current to the magnetization coil;

a control unit for controlling an operation of the inverter circuit; and a temperature sensor for detecting a temperature of the heat-generating body, wherein a portion of the heat-generating body that is heated most by the magnetization coil and the temperature sensor are at different positions on either an upstream side or a down stream side from a nip portion formed between the heat-generating body and the pressure member in a rotating direction of the heat-generating body.

24. The image forming apparatus according to claim 23, wherein the heat-generating body comprises a fixing belt, and the temperature sensor is arranged on a side of a rear surface of the fixing belt.

25. The image forming apparatus according to claim 23, wherein the heat-generating body comprises a heat-generating roller, a fixing roller pressed against the pressure member, and a fixing belt suspended between the heat-generating roller and the fixing roller.

26. The image forming apparatus according to claim 23, wherein the magnetization coil is arranged in opposition to an outer peripheral surface of the heat-generating body.

* * * * *

UNITED STATES PATENT AND TRADEMARK OFFICE

CERTIFICATE OF CORRECTION

PATENT NO. : 6,845,226 B2
DATED : January 18, 2005
INVENTOR(S) : Tatematsu et al.

It is certified that error appears in the above-identified patent and that said Letters Patent is hereby corrected as shown below:

Column 30,
Line 52, "member," should read -- member; --.

Signed and Sealed this

First Day of November, 2005

JON W. DUDAS
*Director of the United States Patent and Trademark Office*